US008404062B2

(12) United States Patent
Ueoka et al.

(10) Patent No.: US 8,404,062 B2
(45) Date of Patent: Mar. 26, 2013

(54) DEVICE AND METHOD FOR COOLING HOT STRIP

(75) Inventors: Satoshi Ueoka, Fukuyama (JP); Naoki Nakata, Fukuyama (JP); Takashi Kuroki, Kawasaki (JP); Nobuo Nishiura, Kawasaki (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 12/449,672

(22) PCT Filed: Jan. 15, 2008

(86) PCT No.: PCT/JP2008/050666

§ 371 (c)(1),
(2), (4) Date: Aug. 19, 2009

(87) PCT Pub. No.: WO2008/117552

PCT Pub. Date: Oct. 2, 2008

(65) Prior Publication Data

US 2010/0024505 A1 Feb. 4, 2010

(30) Foreign Application Priority Data

Feb. 26, 2007 (JP) ..... 2007-044868

(51) Int. Cl.
*C21D 9/573* (2006.01)
*C21D 1/667* (2006.01)

(52) U.S. Cl. ..... 148/661; 148/636; 148/637; 148/638; 148/639; 148/644; 148/657; 148/658; 148/660; 148/664; 266/46; 266/11; 266/113; 266/114; 72/201; 72/364

(58) Field of Classification Search ..... 266/46, 266/111, 113–114, 259; 72/201, 364; 148/636–639, 148/644, 657–658, 660–661, 664
See application file for complete search history.

(56) References Cited

U.S. PATENT DOCUMENTS 6,054,095 A * 4/2000 Minato et al. ..... 266/81

FOREIGN PATENT DOCUMENTS

| | | | |
|---|---|---|---|
| CN | 1049303 | * | 2/1991 |
| EP | 1 935 522 | A1 | 6/2008 |
| JP | 59-144513 | A | 8/1984 |
| JP | 62-260022 | A | 11/1987 |
| JP | 10-249429 | A | 9/1998 |
| JP | 2001-286925 | A | 10/2001 |
| JP | 2003-191005 | A | 7/2003 |
| JP | 2005-059038 | A | 3/2005 |
| JP | 2007-090428 | A | 4/2007 |

(Continued)

*Primary Examiner* — Lois Zheng
(74) *Attorney, Agent, or Firm* — Holtz, Holtz, Goodman & Chick, PC

(57) ABSTRACT

A cooling device and a cooling method for a hot strip allow uniform and stable cooling of the strip at a high cooling rate when supplying the coolant to the upper surface of the hot strip. The cooling device includes an upper header unit 21 for supplying a rod-like flow to the upper surface of the strip 10. The upper header unit 21 is formed of the first upper header group including plural first upper headers 21*a* arranged in a conveying direction and a second upper header group including plural second upper headers 21*b* arranged in the conveying direction. The cooling device is provided with an ON-OFF mechanism 30 to allow each of the upper headers 21*a* and 21*b* of the first and the second upper header groups to independently execute the ON-OFF control (start/end injection control) of an injection (feeding) of the rod-like flow.

7 Claims, 11 Drawing Sheets

FOREIGN PATENT DOCUMENTS

| | | | |
|---|---|---|---|
| JP | 2007-203369 | A | 8/2007 |
| JP | 2007-203370 | A | 8/2007 |
| JP | 2007-260712 | A | 10/2007 |
| WO | WO 2007/026906 | A1 | 3/2007 |

* cited by examiner

DEVICE AND METHOD FOR COOLING HOT STRIP

This application is the United States national phase application of International Application PCT/JP2008/050666 filed Jan. 15, 2008.

TECHNICAL FIELD

The present invention relates to a device and a method for cooling a hot strip in a hot rolling line.

BACKGROUND ART

In general, the hot strip is produced by rolling a slab heated at a high temperature into a desired size, and is cooled with coolant in the hot rolling process or on the run out table after the finish rolling. The above-described cooling with the coolant is performed for the purpose of adjusting the material to obtain the intended strength and ductility by mainly controlling the deposition and transformation of the strip. The accurate control of the temperature at the end of cooling is especially essential to produce the hot strip which exhibits the intended material properties with no variation.

Meanwhile, the generally employed cooling facility (water cooling facility) for the cooling with the coolant may cause such problems as the temperature unevenness or failure to control the intended temperature at the end of cooling.

The aforementioned problems are considered to be caused by the residual coolant on the strip, which will be described taking the case for cooling the strip with the coolant on the run out table.

Generally, the upper side of the strip is cooled by vertically dropping the coolant from the round type nozzle or a slit type nozzle. When the coolant impinges against the strip, it flows forward together with the strip while being kept thereon. The residual coolant is usually discharged through purging. However, purging is performed at the position apart from the spot where the coolant impinges against the strip. The portion of the strip with the residual coolant is locally cooled to cause the temperature unevenness. Especially in the low-temperature zone at 500° C. or lower, the residual coolant in the film boiling state is transformed into the transition boiling state or the nucleate boiling state to intensify the cooling capability. As a result, the temperature difference of the strip between the portion with no residual coolant kept thereon and the portion with the residual coolant kept thereon may occur. In order to avoid the aforementioned difference, the drain purge is intensively performed. However, the transition boiling and the nucleate boiling may cause the residual coolant to adhere to the strip. It is therefore difficult to remove the residual coolant through the drain purge.

Various studies have been made to solve the aforementioned problem.

For example, Patent Document 1 discloses the structure for injecting the coolant from the slit nozzle units each provided with a lift mechanism and arranged opposite the conveying direction to stabilize the cooling operation while maintaining the cooling rate over a wide range by using the separately provided laminar nozzle and spray nozzle.

Patent Document 2 discloses the structure for injecting the film-state coolant by tilting headers each with the slit type nozzle, and filling the coolant with the space between the steel plate and a partition plate so as to establish uniform cooling at the high cooling rate.

Patent Document 1: Japanese Unexamined Patent Application Publication sho 62-260022

Patent Document 2: Japanese Unexamined Patent Application Publication sho 59-144513

DISCLOSURE OF INVENTION

Patent Documents 1 and 2 disclose the very useful technology having the coolant injection nozzles disposed opposite with each other so as not to generate the residual coolant on the strip. However, the structure has not satisfied the requirements yet in view of practical use.

In Patent Document 1, the slit nozzle unit has to be disposed adjacent to the steel plate. When cooling the steel plate with the warped leading end or the warped trailing end, the steel plate may impinge against the slit nozzle unit to be damaged, and the steel plate cannot be moved; thus causing interruption of the manufacturing line and reducing the yielding. The lift mechanism is operated upon passage of the leading end or the trailing end to retract the slit nozzle unit upward. In such a case, the leading end or the trailing end cannot be sufficiently cooled, thus failing to obtain the intended material. Additionally the lift mechanism may increase the facility cost.

In Patent Document 2, the coolant cannot be fully filled in the space defined by the steel plate and the partition plate unless the nozzle is disposed adjacent to the steel plate. When the nozzle is brought to be adjacent to the steel plate, the same problem as described with respect to Patent Document 1 may occur when cooling the steel plate with the warped leading end or the trailing end.

The use of the slit type nozzle (slit nozzle) is assumed in the structure disclosed in Patent Documents 1 and 2. The coolant cannot be brought into the film state unless the injection outlet is constantly kept clean. For example, in the case where the foreign substance is adhered to the injection outlet of the slit nozzle 72 to cause clogging as shown in FIG. 26, the coolant film 73 is broken. The coolant is required to be injected under the high pressure so as to be stemmed in the injection zone (cooling zone). If the coolant 73 in the film state is injected under the high pressure, it may be partially broken owing to the pressure unevenness in a cooling header 71. When the coolant film 73 is not formed well, the coolant may be leaked to the upstream or downstream side of the injection region, which becomes the residual coolant to cause the local excessive cooling. When the slit nozzle is employed for cooling the hot strip, the predetermined gap across the width of 2 m is required to appropriately form the coolant film. However, as the hot strip at the high temperature ranging from 800 to 1000° C. has to be processed, the slit nozzle is likely to be thermally deformed. Thus, it is difficult to perform the gap control.

The present invention provides a device and a method for uniformly and stably cooling the hot strip at the high cooling rate when supplying the coolant to the upper surface of the hot strip.

The present invention provides the following characteristics.

[1] A cooling device for a hot strip is provided with a first cooling header group including nozzles for injecting rod-like flows of a coolant diagonally toward a downstream side of an upper surface of the strip, and a second cooling header group including nozzles for injecting the rod-like flows of the coolant diagonally toward an upstream side of the upper surface of the strip. The first cooling header group and the second cooling header group are oppositely arranged with respect to a strip conveying direction. The nozzle is allowed to supply the coolant with a water amount density of 2.0 $m^3/m^2$ min or higher. Each of the cooling headers of the first cooling header group and the second cooling header group is allowed to switch ON-OFF of the coolant injection independently.

[2] In the cooling device according to the characteristic [1], an injection direction of the rod-like flow is set at an angle in a range from 30° to 60° with respect to a forward direction or an inverse direction of the hot strip based on a horizontal direction.

[3] In the cooling device according to characteristic [1] or [2], an injection angle of the rod-like flow is set so that 0 to 35% of a velocity component of the rod-like flow in the injection direction becomes the velocity component directed outward of the hot strip in a width direction.

[4] In the cooling device according to any one of characteristics [1] to [3], the injection direction of the rod-like flow is set so that the number of the rod-like flows each having the velocity component directed outward of the hot strip in the width direction at one side becomes the same as the number of the rod-like flows each having the velocity component directed outward of the hot strip in the width direction at the other side.

[5] In the cooling device according to any one of characteristics [1] to [4], the nozzles are arranged so that the velocity component of the rod-like flow directed outward of the hot strip in the width direction is gradually increased as a portion of the hot strip is positioned outward from a center of the hot strip in the width direction.

[6] In the cooling device according to any one of characteristics [1] to [4], the nozzles are arranged so that the velocity component of the rod-like flow directed outward of the hot strip in the width direction is kept constant and points where the rod-like flow impinges against the strip are arranged at equal intervals in the width direction of the strip.

[7] In the cooling device according to any one of characteristics [1] to [6], a plate-like or a curtain-like shielding member is disposed inside the nozzles at innermost sides of oppositely disposed first and second cooling header groups and/or above the strip between the first and the second cooling header groups.

[8] A cooling method for a hot strip uses a first cooling header group including nozzles for injecting rod-like flows of a coolant diagonally toward a downstream side of an upper surface of the strip, and a second cooling header group including nozzles for injecting the rod-like flows of the coolant diagonally toward an upstream side of the upper surface of the strip, having the first cooling header group and the second cooling header group oppositely arranged with respect to a strip conveying direction, and includes the steps of supplying the coolant with a water amount density of 2.0 $m^3/m^2$ min or higher from the nozzles, and adjusting a length of a cooling zone by independently switching ON-OFF of each of the cooling headers of the first cooling header group and the second cooling header group.

[9] In the cooling method for a hot strip according to the characteristic [8], an injection direction of the rod-like flow is set at an angle in a range from 30° to 60° with respect to a forward direction or an inverse direction of the hot strip from a horizontal direction.

[10] In the cooling method for a hot strip according to the characteristic [8] or [9], the rod-like coolant is injected so that 0 to 35% of a velocity component of the rod-like flow in the injection direction becomes the velocity component directed outward of the hot strip in a width direction.

[11] In the cooling method for a hot strip according to any one of characteristics [8] to [10], the rod-like flow is injected so that the number of the rod-like flows each having the velocity component directed outward of the hot strip in the width direction at one side becomes the same as the number of the rod-like flows each having the velocity component directed outward of the hot strip in the width direction at the other side.

[12] In the cooling method for a hot strip according to any one of characteristics [8] to [11], the rod-like flow is injected so that the velocity component of the rod-like flow directed outward of the hot strip in the width direction is gradually increased as a portion of the hot strip is positioned outward from a center of the hot strip in the width direction.

[13] In the cooling method for a hot strip according to any one of characteristics [8] to [11], the rod-like flow is injected so that the velocity component of the rod-like flow directed outward of the hot strip in the width direction is kept constant and points where the rod-like flow impinges against the strip are arranged at equal intervals in the width direction of the strip.

[14] In the cooling method for a hot strip according to any one of characteristics [8] to [13], a temperature of the strip is measured at a downstream side in a strip conveying direction, and switching injection from the respective cooling headers ON-OFF based on the measured temperature of the strip to adjust the temperature of the strip to a target temperature.

[15] In the cooling method for a hot strip according to any one of characteristics [8] to [14], the cooling headers at inner sides of oppositely disposed first and the second cooling header groups are preferentially operated for injecting the coolant.

The present invention allows the hot strip to be uniformly and stably cooled at the high cooling rate, thus suppressing the material unevenness, reducing the yield loss, and stabilizing quality.

Figure 1:
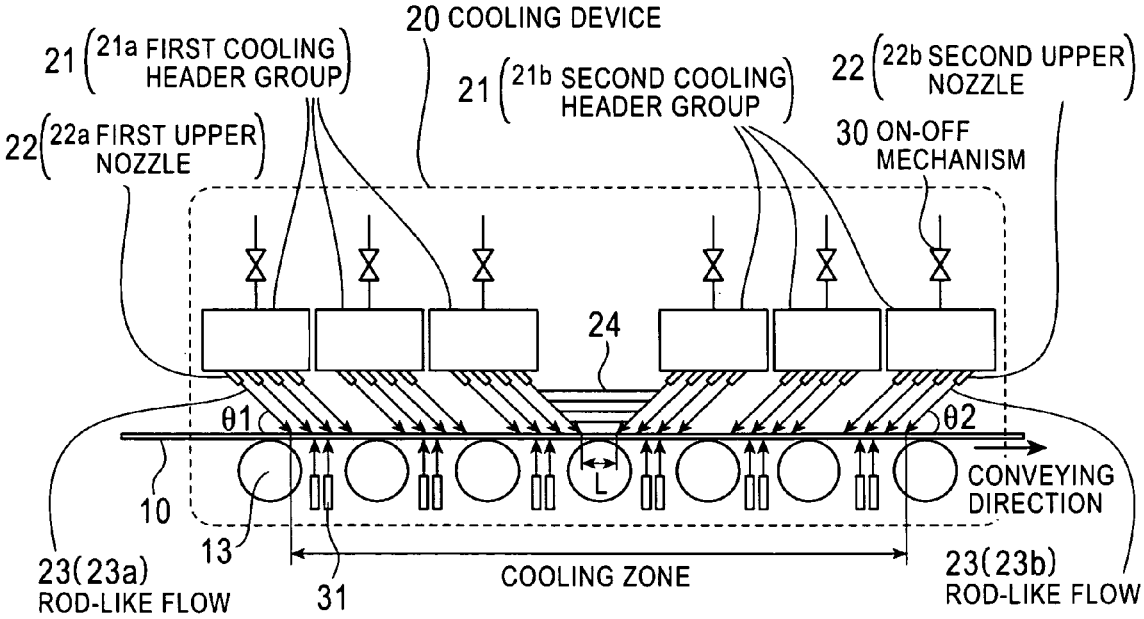
FIG. 1 is an explanatory view of a first aspect of the present invention.

| Reference Numerals | |
|---|---|
| 10 | hot strip |
| 13 | table roll |
| 20 | cooling device |
| 21, 21a, 21b, 21c | upper header |
| 22, 22a, 22b | upper nozzle |
| 23, 23a, 23b | rod-like flow |
| 24 | residual coolant |
| 25 | scattering flow |
| 26 | shielding plate |
| 27 | lift cylinder |
| 28 | shielding curtain |
| 29 | shielding plate |
| 30 | ON-OFF mechanism |
| 31 | lower nozzle |
| 51, 51a, 51b, 51c | cooling device according to the present invention |
| 52, 52a, 52b | existing cooling device |
| 60 | heating furnace |
| 61 | roughing stand |
| 62 | finishing stand |
| 63 | coiler |
| 65 | radiation thermometer |
| 71 | cooling header |
| 72 | slit nozzle |
| 73 | coolant film |
| 74 | foreign substance |

BEST MODE FOR CARRYING OUT THE INVENTION

Aspects of the present invention will be described referring to the drawings.

First Aspect

FIG. 1 is an explanatory view of a cooling device for a hot strip according to a first aspect of the present invention.

A cooling device 20 according to the aspect is disposed in a rolling line of the hot strip, and is provided with upper header units 21 for supplying rod-like flows to the upper surface of a strip 10 conveyed on a table roll 13.

The upper header unit 21 includes a first upper header group with plural first upper headers 21*a* which are arranged in the conveying direction and a second upper header group including plural second upper headers 21*b* which are arranged in the conveying direction downstream of the first upper header group. The upper headers 21*a* and 21*b* of the first and the second header groups are provided with ON-OFF mechanisms 30 each of which allows ON-OFF control (controlling start/end of the coolant supply) of injection (supply) of the rod-like flows independently. In the aforementioned case, each of the first and the second upper header groups includes three upper headers, respectively.

Upper nozzles 22 in plural rows (in this case, four rows in the direction for conveying the strip 10) in the conveying direction are installed in the upper headers 21*a* and 21*b*, respectively. The upper nozzles (first upper nozzles) 22*a* of the first upper header 21*a* and the upper nozzles (second upper nozzles) 22*b* of the second upper header 21*b* are arranged such that the rod-like flows 23*a* and 23*b* injected from the respective nozzles are oppositely directed with respect to the conveying direction of the strip 10. That is, the first upper nozzles 22*a* are arranged to diagonally inject the rod-like flows 23*a* to the downstream side on the upper surface of the strip at the depression (injection angle) of θ1. The second upper nozzles 22*b* are arranged to inject the rod-like flows 23*b* to the upstream side on the upper surface of the strip at a depression (injection angle) of θ2.

The region defined by the points at which the rod-like flows from the upper nozzles each in the farthest rows from the corresponding upper headers in the strip conveying direction (the outermost row) impinge against the strip 10 becomes the cooling zone.

Injection lines of the rod-like flows 23*a* from the first upper nozzles 22*a* are designed not to intersect those of the rod-like flows 23*b* from the second upper nozzles 22*b* such that the film of the residual coolant 24 shown in FIG. 1 is stably formed in the region defined by the points at which the rod-like flows from the upper nozzles in the closest rows (innermost rows) from the corresponding upper headers in the strip conveying directions impinge against the strip 10. The rod-like flows from the upper nozzles in the rows which are the closest to the respective upper headers (innermost rows) are injected to the film of the residual coolant 24. The aforementioned structure is preferable as the rod-like flows are not destroyed with each other. It is assumed that the gap between the points at which the rod-like flows from the upper nozzles in the innermost rows impinge against the strip 10 is referred to as the length L of the residual region. The length L of the residual region is cooled only by the residual coolant 24 while having no impingement of the rod-like coolant against the strip. The contact between the strip 10 and the coolant is instable, which may cause the temperature unevenness. When the length L of the residual region is set to be within 1.5 m, the strip 10 is cooled by the residual coolant 24 less frequently to prevent the temperature unevenness caused by the residual coolant 24. It is therefore preferable to set the length L of the residual region as short as approximately 100 mm.

The rod-like flow refers to the coolant injected from the circular (elliptical or polygonal shape may be included) nozzle outlet. The rod-like flow does not correspond to the spray jet nor the film-like laminar flow, but has the cross section kept substantially circular until the flow from the nozzle injection outlet impinges against the strip while having the linear continuity.

Figure 3A:
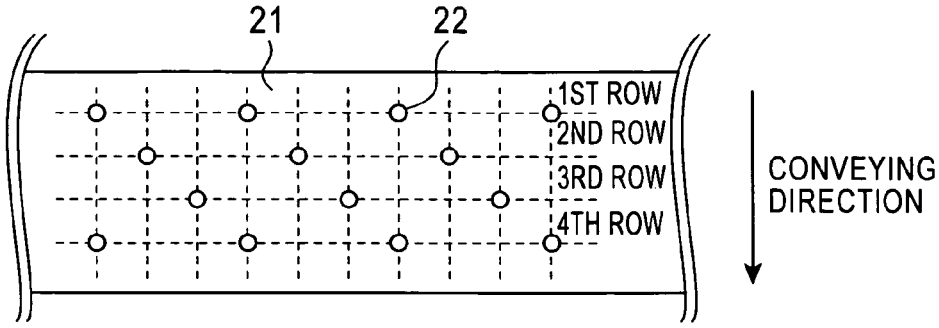
FIGS. 3A and 3B are explanatory views of the first aspect of the present invention.
Figure 3B:
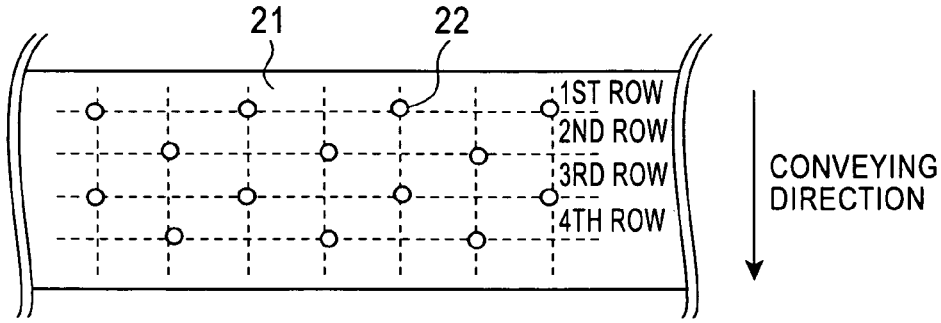

FIGS. 3A and 3B show exemplary arrangements of the upper nozzles 22 (22*a*, 22*b*) installed in the upper header (21*a*, 21*b*). Plural rows (four rows) of the single line of the nozzles at predetermined installation intervals in the width direction of the strip are provided so as to supply the rod-like flows of the coolant to the full width of the passing strip. The nozzles are arranged such that the point where the rod-like flow injected from the nozzle in the row impinges in the strip width direction is displaced from the point where the rod-like flow injected from the nozzle in the next row impinges in the strip width direction. Referring to FIG. 3A, the aforementioned point of the nozzle in the next row is displaced from the point of the nozzle in the previous row by approximately ⅓ of the installation interval in the width direction. Referring to FIG. 3B, the aforementioned points are displaced by approximately ½ of the installation interval in the width direction.

In the case where the strip width component is contained in the rod-like flow injected from the nozzle, the point at which the nozzle is installed in the strip width direction is different from the point at which the rod-like flow impinges in the strip width direction as described later. In the aforementioned case, the nozzle installation point is required to be adjusted such that the impingement point of the rod-like flow in the strip width direction is brought into the desired position (distribution).

As the upper nozzles 22 in the single row may weaken the force for the purge by stemming the residual coolant between the rod-like flow which impinges against the strip and the adjacent rod-like flow, the upper nozzles 22 in plural rows are required in the conveying direction. The upper nozzles in the plural rows are required to stem the residual coolant, and it is preferable to provide the upper nozzles 22 in three or more rows to be installed in the respective upper headers 21. It is more preferable to provide the upper nozzles 22 in five or more rows.

It is essential to separately install the upper nozzles 22 in the plural upper headers, respectively for conducting the temperature control of the hot strip. The hot strips each with the different thickness are required to be cooled to a predetermined temperature. The cooling has to be performed at the rate as high as possible for the purpose of establishing the production volume. The adjustment of the cooling time is necessary for adjusting the intended temperature, and accordingly, each length of the cooling zone has to be changed to the different value. The upper nozzles are separately installed in the plural upper headers, respectively such that each of the upper headers is allowed to control ON-OFF of the injection of the rod-like flow. As a result, the length of the cooling zone may be freely changed. The upper nozzles in at least the single row may be attached to the respective headers. The number of the rows in which the nozzles are installed is determined in accordance with the intended temperature control capability. In the case where the allowable temperature variation (for example, ±8° C.) is larger than the temperature (for example, 5° C.) for cooling the strip per row, the number of rows in which the nozzles are installed for each header may be increased in the range which is adjustable into the allowable range. For example, the cooling/lowering temperature at the single upper header may be set to be lower than 16° C. for adjusting the temperature unevenness of 8° C. (temperature range of 16° C.). The use of the upper nozzles in three rows for the upper headers allows the temperature adjustment by the unit of 15° C. It is therefore possible to adjust the strip temperature after cooling in the allowable range. Meanwhile, if the number of rows in which the nozzles are installed in the upper headers, the temperature adjustment will be performed by the unit of 20° C. to deviate from the intended temperature region (16° C.), which is unfavorable. The number of the rows for the upper nozzles per the upper header has to be adjusted in accordance with the cooling temperature of the cooling device and the intended allowable temperature error (allowable temperature variation).

The number of the upper headers 21 and the number of the rows for the upper nozzles 22 are required to be determined so as to establish two requirements, that is, to stem the residual coolant and to obtain the predetermined cooling capability.

The cooling device 20 supplies the rod-like flows 23 from the upper headers 21*a*, 21*b* to the upper surface of the strip 10 such that the water amount density on the strip surface becomes 2.0 $m^3/m^2$ min or higher.

The reason why the water amount density is set to 2.0 $m^3/m^2$ min or higher will be described hereinafter. The supplied rod-like flows 23*a* and 23*b* are stemmed to form the residual coolant 24 as shown in FIG. 1. When the water amount density is low, the stemming operation cannot be performed. When the water amount density becomes higher than a predetermined value, the amount of the residual coolant 24 capable of stemming is increased to achieve the amount balance between the coolant drained from the strip width end and the supplied coolant, thus maintaining the residual coolant 24 constant. Normally, the hot strip has the thickness ranging from 0.9 to 2.1 m. If it is cooled at the water amount density of 2.0 $m^3/m^2$ min or higher, the aforementioned thickness is sufficient to maintain the residual coolant 24 constant.

As the water amount density is increased to be equal to or higher than 2.0 $m^3/m^2$ min, the rate for cooling the hot strip is accelerated. This makes it possible to reduce the length of the cooling zone required for cooling to the predetermined temperature. As a result, the space for accommodating the cooling device 20 may be made compact. The cooling device 20 may be accommodated between the existing facilities for cooling as well as reducing the cost for building the facility.

The cooling device 20 is structured such that the rod-like flow injected from the first upper nozzle 22*a* and the rod-like flow 23*b* injected from the second upper nozzle 22*b* are oppositely positioned with respect to the conveying direction of the strip 10. The injected rod-like flows 23*a* and 23*b* stem the residual coolant 24 on the upper surface of the strip 10, which are about to move along the conveying direction of the strip 10. Even if the coolant at the large water amount density of 2.0 $m^3/m^2$ min or more is supplied, the stabilized cooling zone is obtained to realize uniform cooling.

As the rod-like flows injected from the upper nozzles 22*a* and 22*b* are capable of forming the stream in the state more stable than the film type coolant injected from the slit nozzle, for example, the large force for stemming the residual coolant may be obtained. In the case where the film type coolant is diagonally injected, as the distance from the steel plate to the nozzle increases, the coolant film adjacent to the strip becomes thinner. The flow, thus is likely to be broken.

It is preferable to set both the injection angle θ1 of the first upper nozzle 22*a* and the injection angle θ2 of the second upper nozzle 22*b* to be in the range from 30° to 60°. If each of those injection angles θ1 and θ2 is smaller than 30°, each velocity component of the rod-like flows 23*a* and 23*b* in the vertical direction is made small. Accordingly, the impingement force against the strip 10 is weakened to deteriorate the cooling capability. If each of the injection angles θ1 and θ2 is larger than 60°, the velocity component of the rod-like flow in the conveying direction is made small. Accordingly, the force for stemming the residual coolant 24 is weakened. The injection angles θ1 and θ2 do not have to be set to the same value.

The plural rows of the upper nozzles (injection from three or more rows) are required to be arranged in the longitudinal direction to stem the residual coolant. It is preferable to set the injection rate of the rod-like flow injected from the upper nozzle 22 to 8 m/s or higher for further improving the effect for stemming the residual flow.

It is preferable to set the inner diameter of the upper nozzle 22 to be in the range from 3 to 8 mm for avoiding clogging of the nozzle and maintaining the rod-like flow injection rate.

The rod-like flow is likely to flow from the gap between the adjacent rod-like flows in the width direction. In this case, as described referring to FIGS. 3A and 3B, it is preferable to displace the point where the rod-like coolant in the previous row impinges in the width direction from the point where the rod-like coolant in the next row impinges against the strip in the width direction. The rod-like flow in the next row impinges against the point at which the purge capability between the adjacent rod-like flows in the width direction is weakened. This may complement the purge capability.

The pitch (installation interval in the width direction) for installing the upper nozzle 22 in the width direction may be within 20 times larger than the inner diameter of the nozzle so as to provide excellent purging property.

It is preferable to keep the leading end of the upper nozzle 22 apart from the pass line for the purpose of preventing breakage of the upper nozzle 22 caused by the warrpage of the strip 10. If they are apart from each other too far, the rod-like flow is dispersed. Accordingly, it is preferable to set the distance between the leading end of the upper nozzle 22 and the pass line to be in the range from 500 mm to 1800 mm.

Figure 4:
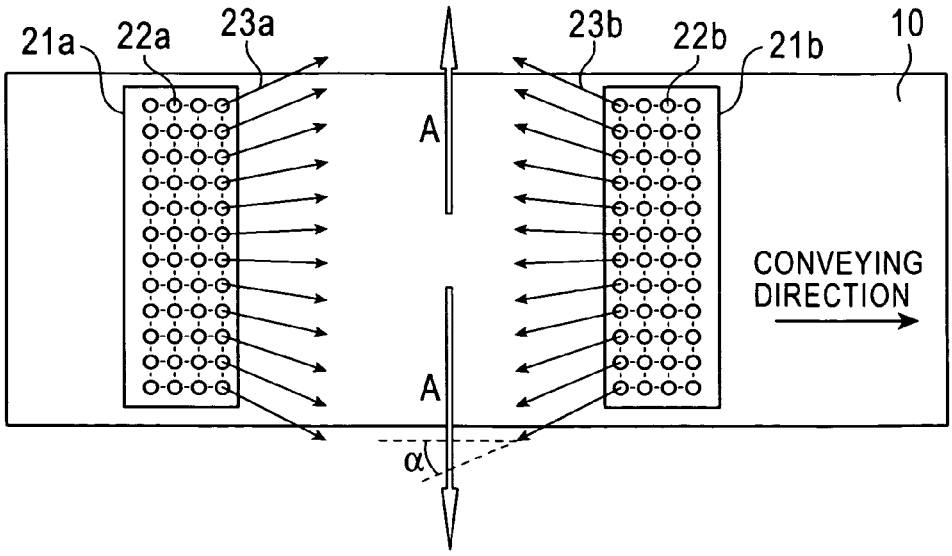
FIG. 4 is an explanatory view of the first aspect of the present invention.
Figure 5:
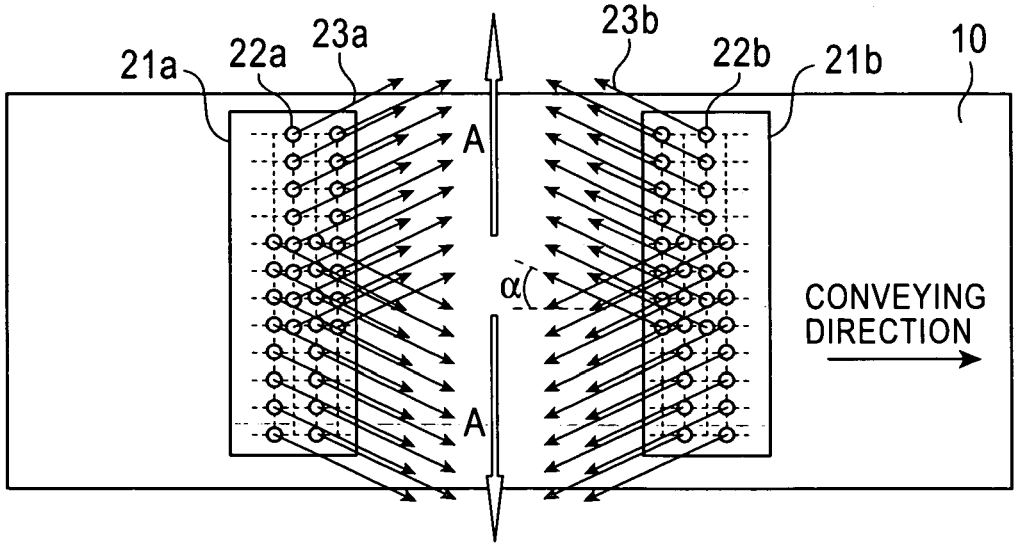
FIG. 5 is an explanatory view of the first aspect of the present invention.
Figure 6:
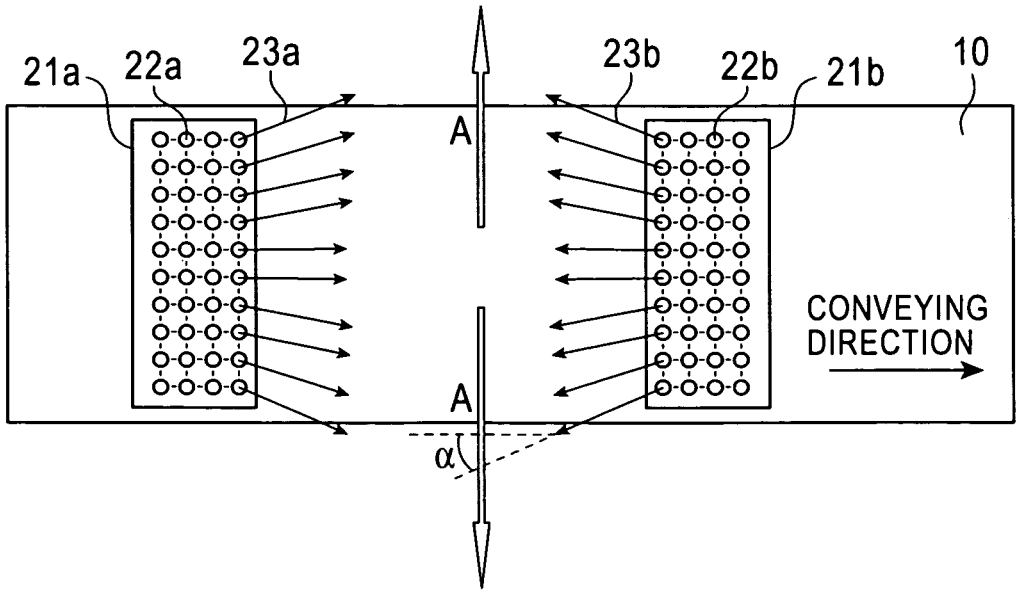
FIG. 6 is an explanatory view of the first aspect of the present invention.

Referring to FIGS. 4, 5 and 6, when the injecting direction of the rod-like flow is set at the outward angle α such that 0 to 35% of the velocity component of the rod-like flow in the injection direction becomes the one toward the strip width direction, the rod-like flow injected from the upper nozzle 22 to the strip 10 joins as indicated by the arrow A shown in FIGS. 4, 5 and 6 to immediately drop from the width end of the strip 10. This makes it possible to stem the residual coolant for purging at the lower pressure with smaller amount of the coolant compared with the case where the rod-like flow exhibits no velocity component directed outward of the strip width direction. The aforementioned structure is preferable in view of the economical facility design. It is more preferable to set the velocity component to be in the range from 10 to 35%. If it exceeds 35%, the facility cost for preventing scattering of the coolant in the width direction is required, and the velocity component of the rod-like flow in the vertical direction is reduced, thus deteriorating the cooling property.

It is preferable to have 40% to 60% of the total number of the nozzles arranged in the strip width direction designed to inject the rod-like flows each with the component directed outward at one side in the strip width direction. If the number of the nozzles directed outward at one side in the strip width direction exceeds 60% of the total number of the nozzles to cause unevenness in the discharge of the coolant from the width end, the rod-like flow fails to stem the residual coolant at the point with the increased thickness. This may cause the temperature unevenness in the width direction. If the amount of the scattering flow is made too large at one outer side in the strip width direction, the facility cost for preventing the increase in the scattering flow becomes high.

Referring to FIG. 5, in the case where the flow is injected to both outer sides at the constant outward angle α, they can be arranged at the ratios of the nozzle for injection outward in the strip width direction at 40% for one side, and at 60% for the other side. Preferably, they are arranged at the ratio of 50% for one side, and of 50% for the other side, respectively.

Referring to FIG. 4, the outward angle α may be gradually increased to the outer side in the strip width direction. In such a case, it is preferable to have the outward angle α dispersed symmetrically with respect to the center of the strip width.

Referring to FIG. 6, the number of the upper nozzles intended not to be directed outward in the strip width direction (outward angle α=0) is set to be equal to or smaller than 20% of the total number of the upper nozzles, and each number of the rest of the nozzles directed outward at both sides is substantially the same (for example, 40% for each side) to smoothly purge the residual coolant. The purging by stemming the residual coolant may be preferably performed.

Figure 7:
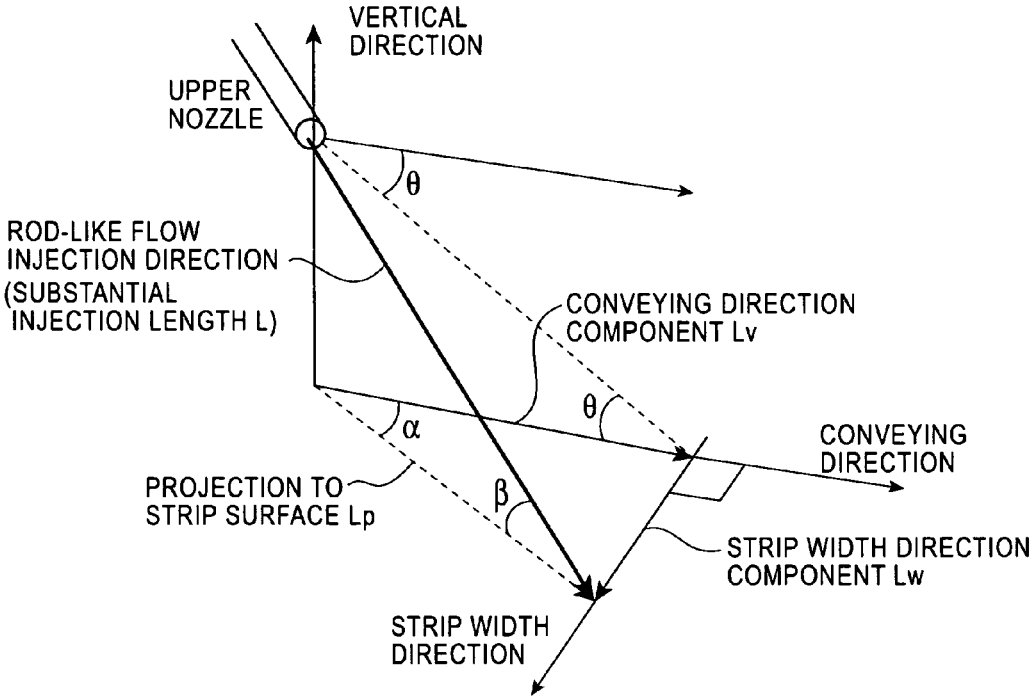
FIG. 7 is an explanatory view of the first aspect of the present invention.

Referring to FIG. 7, determination with respect to the injection direction of the aforementioned rod-like flow will be described in detail.

FIG. 7 represents the injection direction of the rod-like flow using β which denotes the angle formed by the injection line of the rod-like flow and the strip (actual depression), θ which denotes the depression with respect to the conveying direction, and α which denotes the angle directed outward in the strip width direction. The velocity component is set such that 0 to 35% of the velocity component to the injection direction of the rod-like flow is directed outward in the strip width direction in order to set the ratio of the length Lw corresponding to the velocity component in the strip width direction vertical to the conveying direction Lw to the substantial injection length L of the coolant (velocity component ratio in the width direction), that is, Lw/L to the value in the range from 0 to 35%. Table 1 shows the calculated results while assuming that the height of the injection outlet of the upper nozzle is set to 1200 mm, and the depressions θ with respect to the conveying direction are set to 45° and 50°. The velocity component ratio in the width direction is in the range from 0 to 35% when the outward angle α is in the range from 0 to 25° at the depression θ of 45° with respect to the conveying direction, and the outward angle α is in the range from 0 to 30° at the depression θ of 50° with respect to the conveying direction, respectively.

TABLE 1

| | | | | | | | | | |
|---|---|---|---|---|---|---|---|---|---|
| | Nozzle height | h | mm | 1200 | 1200 | 1200 | 1200 | 1200 | 1200 |
| Depression | Conveying direction | θ | deg | 45 | 45 | 45 | 45 | 45 | 45 |
| | Substantial value | β | deg | 45.0 | 44.6 | 44.0 | 43.2 | 42.2 | 40.9 |
| | Outward angle | α | deg | 0 | 10 | 15 | 20 | 25 | 30 |
| Injection length | Conveying direction | Lv | mm | 1200 | 1200 | 1200 | 1200 | 1200 | 1200 |
| | Width direction | Lw | mm | 0 | 212 | 322 | 437 | 560 | 693 |
| | Projection length on plate surface | Lp | mm | 1200 | 1219 | 1242 | 1277 | 1324 | 1386 |
| | Substantial length | L | mm | 1697 | 1710 | 1727 | 1752 | 1787 | 1833 |
| Velocity component ratio in width direction | | Lw/L | % | 0% | 12% | 19% | 25% | 31% | 38% |
| | Nozzle height | | | 1200 | 1200 | 1200 | 1200 | 1200 | 1200 |
| Depression | Conveying direction | | | 50 | 50 | 50 | 50 | 50 | 50 |
| | Substantial value | | | 50.0 | 49.6 | 49.0 | 48.2 | 47.2 | 45.9 |
| | Outward angle | | | 0 | 10 | 15 | 20 | 25 | 30 |
| Injection length | Conveying direction | | | 1007 | 1007 | 1007 | 1007 | 1007 | 1007 |
| | Width direction | | | 0 | 178 | 270 | 366 | 470 | 581 |
| | Projection length on plate surface | | | 1007 | 1022 | 1042 | 1072 | 1111 | 1163 |
| | Substantial length | | | 1566 | 1577 | 1590 | 1609 | 1635 | 1671 |
| Velocity component ratio in width direction | | | | 0% | 11% | 17% | 23% | 29% | 35% |

As described above, FIG. 4 is a plan view showing an example having the upper nozzles 22*a* and 22*b* installed based on the aforementioned structure. It is assumed that the outward angle α of the rod-like flow injected from the nozzle at the center in the strip width direction is set to 0°, and the outward angle α is gradually increased as the nozzle position moves to the outer side in the strip width direction. When the upper nozzles are installed in the upper header at equal intervals in the strip width direction, the points where the rod-like flows impinge against the strip are not positioned at equal intervals in the strip width direction. So the points at which the upper nozzles are installed in the upper header in the width direction (installation interval in the width direction) are adjusted such that the points where the rod-like flows impinge against the strip are arranged at equal intervals (for example, at the pitch of 60 mm).

FIG. 5 is a plan view showing another example having the upper nozzles 22*a* and 22*b* installed as described above. In this case, the outward angle α of the injected coolant is kept constant (for example, 20°), and the respective nozzles are arranged such that the points at which the rod-like flows impinge against the strip are disposed at equal intervals (at the pitch of 100 mm, for example) to the rear of the strip width. The nozzle for injecting the coolant to both the left and right outer sides is required to be disposed at the center to the rear of the strip width. For this, the row of nozzles for injection toward one outer side in the strip width direction (for example, the row of nozzles with the injection velocity component in the upward direction as shown in FIG. 5) and the row of nozzles for injection toward the other outer side in the strip width direction (for example, the row of nozzles with the injection velocity component in the downward direction as shown in FIG. 5) are disposed while being displaced alternately at a predetermined interval (for example, 25 mm) with respect to the conveying direction. As a result, the number of the nozzles for injecting the rod-like flow with the velocity component toward one outer side in the strip width direction may become equal to that of the nozzles for injecting the rod-like flow with the velocity component toward the other outer side.

As described above, FIG. 6 is a plan view showing another example having the upper nozzles 22*a* and 22*b* installed according to the aforementioned structure. In this case, 20% of all the nozzles are structured not to inject outward in the width direction at the outward angle α of 0°. The rest of the nozzles are disposed each at the constant outward angle (for example, α=20°). Assuming that the point at which the rod-like flow injected from the nozzle impinges against the strip is at the boundary between the nozzle at the outward angle α of 0° in the center of the width and the nozzle at the outward angle α of 20° at the outer side in the width direction, if the nozzles are disposed at equal intervals in the width direction at the nozzle header side, the impingement positions are not arranged at equal intervals in the width direction. For this, it is preferable to adjust the point at which the nozzle for injecting the rod-like flow is installed in the nozzle header so as to make the intervals at the impingement points equal. If the outward angle α is increased, it is possible to purge using less coolant. On the contrary, the nozzle installation density in the header around the center of the strip width direction is increased. The outward angle α may be determined in consideration with the capacity of the pump for supplying the coolant to the header and the pipe radius so as to obtain the uniform flow rate distribution in the strip width direction.

The outward angle α may be set to 0° so long as the pump capacity and the pipe diameter sufficiently satisfy the requirements.

It is preferable to form the water-proof wall and the exhaust port on both outer sides of the aforementioned cooling facility because they are effective for preventing leakage of the coolant from the facility and scattering inside the facility to form the residual coolant.

When the outward angle α exceeds 30°, the facility cost is added for preventing scattering of the coolant, and the vertical component of the rod-like flow is reduced, thus lowering the cooling capacity.

Figure 2:
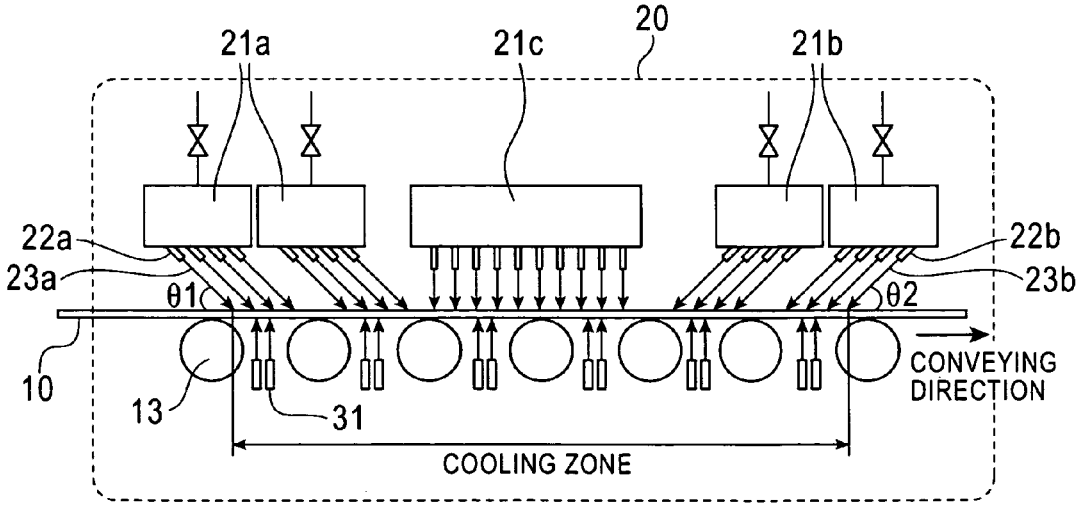
FIG. 2 is an explanatory view of the first aspect of the present invention.

The cooling device 20 according to the aspect includes three upper headers 21*a* and 21*b*, respectively as shown in FIG. 1. Each number of the upper headers 21*a* and 21*b* may be increased for making the facility length long to satisfy the requirement of the cooling capacity. Alternatively, plural cooling devices 20 may be provided in the strip conveying direction. Furthermore, as shown in FIG. 2, arbitrary numbers of intermediate headers 21*c* may be interposed between the upper headers 21*a* and 21*b*. The nozzle arrangement, the outward angle α, and the water amount density of the intermediate header 21*c* may be the same as those of the upper headers 21*a*, 21*b* except that the depression θ with respect to the conveying direction is set to 90°. In such a case, plural upper heads 21*a*, 21*b* may be employed.

In the aspect as described above, the upper headers 21*a* and 21*b* connected to the upper nozzles 22*a* and 22*b* for injecting the rod-like flows each at the water amount density of 2.0 $m^3/m^2$ min and higher are disposed above the hot strip 10. The upper nozzles 22*a* and 22*b* are oppositely disposed with respect to the conveying direction of the hot strip 10 at the depressions θ1 and θ2 formed by the respective rod-like flows 23*a* and 23*b*, and the hot strip 10 in the range from 30° to 60°. The rod-like flow is injected while having 0 to 35% of the velocity component of the rod-like flow in the forward direction outward in the strip width direction to supply the coolant to the upper surface of the hot strip 10. The hot strip in the hot rolling line may be uniformly and stably cooled to the target temperature at the high cooling rate, thus allowing production of the strip with high quality.

Second Aspect

In the first aspect, in the case where each injection rate of the rod-like flows 23*a* and 23*b* from the oppositely disposed upper nozzles 22*a* and 22*b* is high, for example, 10 m/s or higher, the rod-like flows 23*a* and 23*b* impinge against the strip 10 and scatter upward while being hit with each other. If the scattering flow drops onto the residual coolant 24, no problem occurs. However, if the scattering flow 25 which scatters diagonally upward to drop on the rod-like flows 23*a* and 23*b*, it will leak from the gap between the rod-like flows 23*a* and 23*b*. As a result, this may fail to conduct the complete purging. Such problem is likely to occur especially when the residual zone length is within 200 mm. In the case where the injection rate of the coolant is high, the scattering flow 25 jumps over the upper headers 21*a* and 21*b* to drop on the strip 10.

Figure 8:
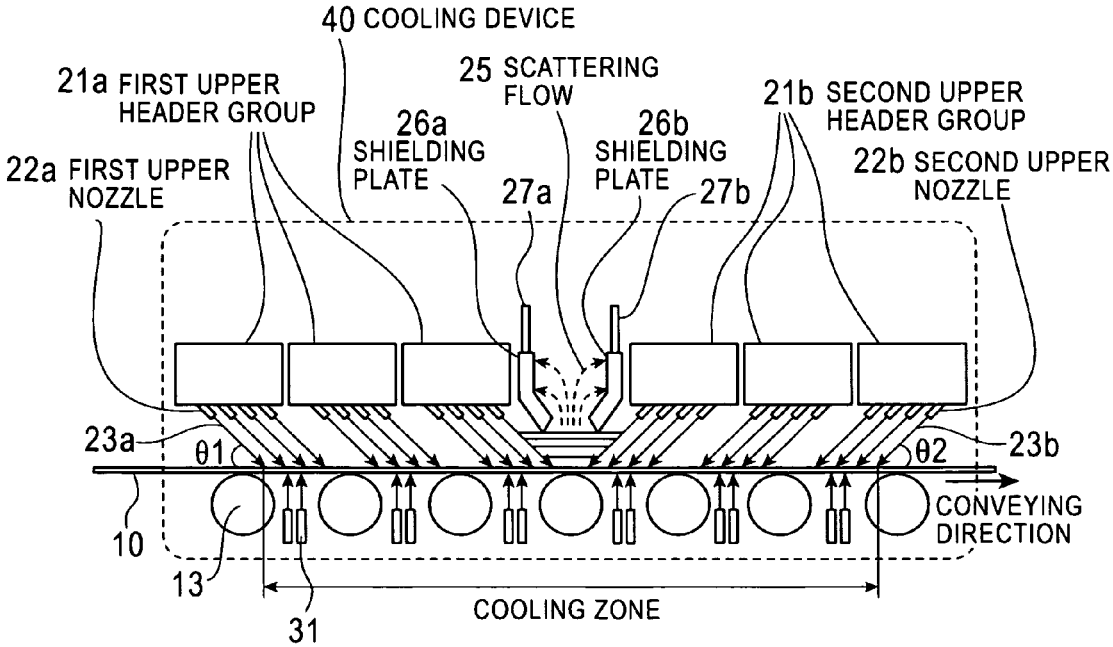
FIG. 8 is an explanatory view of a second aspect of the present invention.

Meanwhile, a cooling device 40 according to the second aspect as shown in FIG. 8 is formed by adding shielding plates 26*a* and 26*b* inside the innermost rows of the oppositely disposed upper nozzles 22*a* and 22*b* of the cooling device 20 according to the first aspect. Preferably, the shielding plates 26*a* and 26*b* are disposed to cover the upper sides of the rod-like flows 23*a* and 23*b* injected from the upper nozzles 22*a* and 22*b*.

Even if the scattering flow 25 scatters diagonally upward, the dropping scattering flow 25 may be shielded by the shielding plates 26*a* and 26*b* so as not to drop onto the rod-like flows 23*a* and 23*b* but to drop onto the residual coolant 24. This ensures to conduct the appropriate purging.

The shielding plates 26*a* and 26*b* may be structured to be lifted by cylinders 27*a* and 27*b*, respectively only for manufacturing the product which requires the shielding plates 26*a* and 26*b*. Besides the aforementioned case, they are lifted to the retracted positions.

It is preferable to set each lowermost end of the shielding plates 26*a* and 26*b* is above the upper surface of the strip 10 by the distance from 300 to 800 mm. They are positioned above the upper surface of the strip 10 by the distance equal to or higher than 300 mm so as to avoid impingement against the strip having the leading end or the trailing end warped upward. If they are apart from the upper surface of the strip 10 to be higher than 800 mm, they may fail to sufficiently shield the scattering flow 25.

Figure 9:
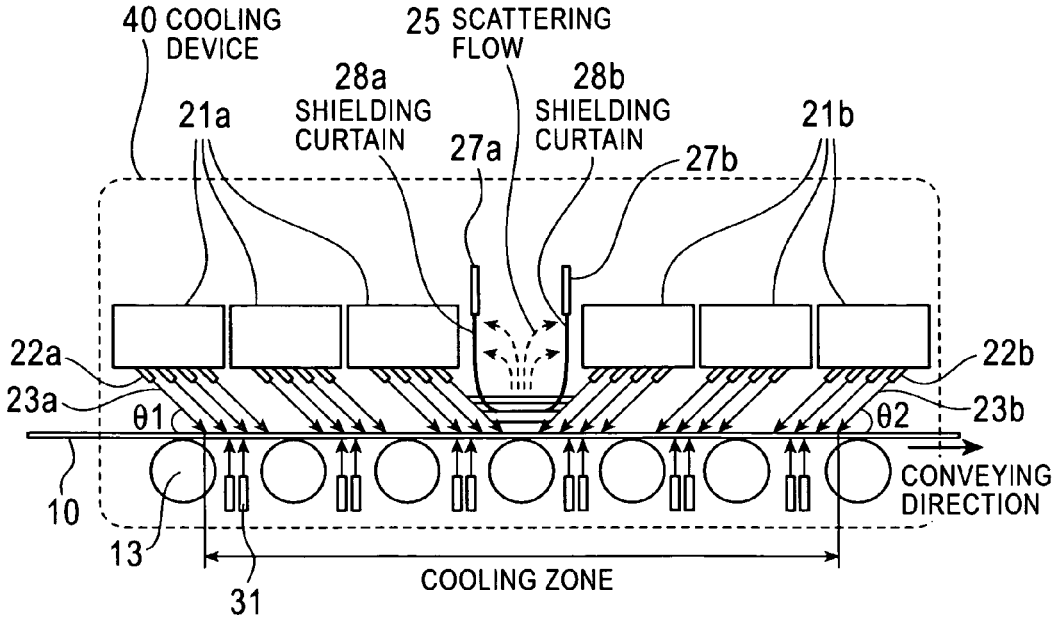
FIG. 9 is an explanatory view of the second aspect of the present invention.

Instead of the shielding plates 26*a* and 26*b* shown in FIG. 8, shielding curtains 28*a* and 28*b* each having a light and smooth surface may be employed as shown in FIG. 9. Normally, the shielding curtains 28*a* and 28*b* are kept hang down in a standby mode. When injection of the rod-like flows 23*a* and 23*b* is started, they are lifted along the rod-like flow in the innermost row. As the rod-like flows 23*a* and 23*b* are injected vigorously, the respective flows are never disturbed.

Figure 10:
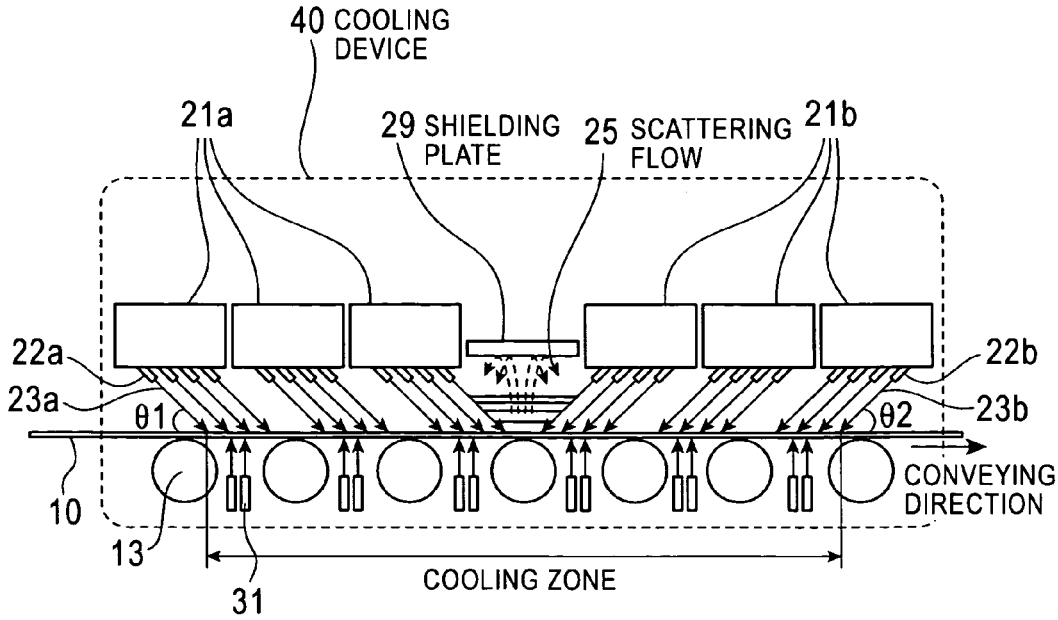
FIG. 10 is an explanatory view of the second aspect of the present invention.
Figure 11:
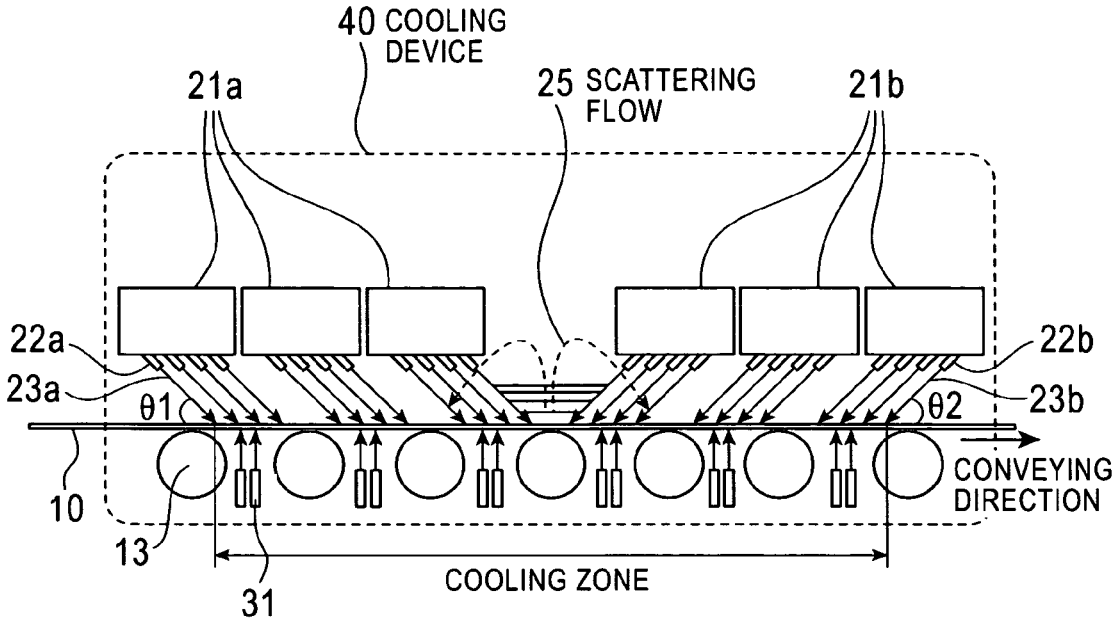
FIG. 11 is an explanatory view with respect to the second aspect of the present invention.

In the case where the injection rate of the coolant is so high that the scattering flow 25 jumps over the upper headers 21*a* and 21*b* to drop onto the strip 10, a shielding plate 29 positioned above the strip between the upper headers 21*a* and 21*b* as shown in FIG. 10 may be employed. The use of the shielding plate 29 makes sure to shield the scattering flow which jumps over the upper headers 21*a* and 21*b* to drop onto the strip 10. Such use is effective for the case where the scattering flow which impinges against the shielding plate 29 drops down while causing the scattering flow in the lateral direction to drop onto the residual coolant 24 together.

In the second aspect, each number of the upper headers 21*a* and 21*b* may be adjusted for regulating the temperature at the end of cooling as described in the first aspect.

In the aspect, the scattering flow is ensured to be shielded by such member as the shielding plate. This makes it possible to uniformly and stably cool the strip to the target temperature at the high cooling rate, and accordingly, to manufacture the strip with higher quality.

In the first and the second aspects, cooling of the lower side of the strip is not explained. As the residual coolant hardly resides on the lower side of the strip to cause excessive cooling, the generally employed cooling nozzle (spray nozzle, slit or round type nozzle) may be used as a lower nozzle 31. The strip may be cooled only through the upper side cooling according to circumstances.

Third Aspect

A third aspect of the present invention realized by disposing the cooling device 20 according to the first aspect of the invention, or the cooling device 40 according to the second aspect in a hot strip rolling line for cooling the hot strip will be described.

Figure 12:
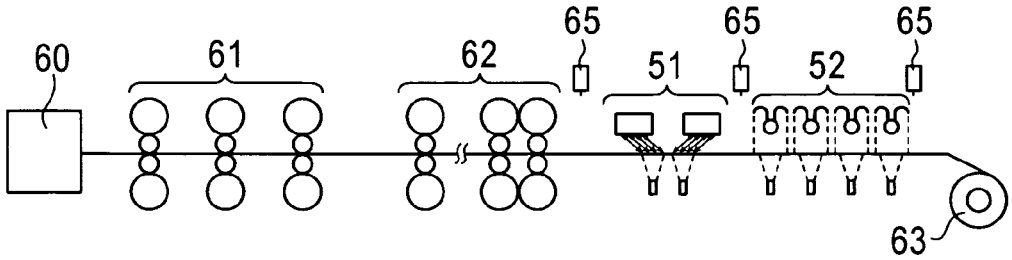
FIG. 12 is an explanatory view of a third aspect of the present invention.

FIG. 12 shows an exemplary system formed by introducing the third aspect in the row of the generally employed hot strip facility. The slab heated to the predetermined temperature in a heating furnace 60 is rolled by a roughing stand 61 to the predetermined temperature and the predetermined thickness. It is further rolled by a finishing stand 62 to the predetermined temperature and the predetermined thickness, and cooled to the predetermined temperature by a cooling device 51 of the present invention (cooling devices 20, 40) and a generally employed cooling device 52 (upper side cooling: pipe laminar cooling, lower side cooling: spray cooling) so as to be coiled by a coiler 63.

It is assumed that the cooling device 51 according to the present invention includes three upper headers 21*a* and 21*b*, respectively. A radiation thermometer 65 is disposed at an output side of the cooling device 51 according to the present invention.

The case where the strip is finished to the thickness of 2.8 mm at 820° C., sharply cooled by the cooling device 51 of the present invention to 650° C., and further cooled by the existing cooling device 52 to 550° C. will be described with respect to the strip material.

Before the hot strip is fed to the cooling device 51, the number of the cooling headers required for cooling the strip to the predetermined temperature is calculated with the calculator such that the coolant is injected from the calculated numbers of the cooling headers.

After feeding the strip into the cooling device 51, the temperature is measured by the radiation thermometer 65 at the output side of the cooling device 51. The number of the cooling headers of the cooling device 51 for injecting the coolant is adjusted based on the difference between the target temperature and the actual temperature.

The hot strip may be cooled while accelerating the feed rate depending on the condition. In case of the condition having no acceleration or low acceleration ratio, each number of the cooling headers for injecting the coolant to the leading end and the trailing end of the strip may be the same. When the cooling is conducted for the entire length while keeping each number of the respective headers for injecting the coolant unchanged at the high acceleration ratio, the times taken for the leading end and the trailing end to pass the cooling device become different from each other, and accordingly, the cooling time changes. As the passage point of the strip approaches the trailing end, the cooling time becomes short, thus failing to be sufficiently cooled. In consideration with the aforementioned point, the number of the cooling headers for injecting the coolant has to be increased as the point approaches the trailing end of the strip.

The process for increasing the number of the cooling headers for injecting the coolant during the cooling will be described.

It is preferable to increase the number of the cooling headers from the inner to the outer side sequentially. As described above, it is preferable to set the length of the residual zone to be equal to or shorter than 1.5 m for the stable cooling so as to avoid the risk of instability caused by injecting the coolant from both the outermost sides only. If the number of the cooling headers for injecting the coolant is increased from the inner to the outer side sequentially, the length of the residual zone may be kept short.

It is preferable to make the number of rows of the first upper nozzles 22*a* for injecting the rod-like flows to the downstream side accorded with the number of the rows of the second upper nozzles 22*b* for injecting the rod-like flows to the upstream side. In the state where the first and the second upper nozzles 22*a* and 22*b* are oppositely disposed to inject the rod-like flows, if the momentum of the rod-like flow each injected from each of the respective nozzles is largely different, the rod-like flow with the large momentum overcomes the rod-like coolant with the smaller momentum. So the nozzle group with the smaller momentum cannot provide sufficient stemming effects.

If the numbers of the first and the second upper headers for injecting the coolant cannot be made equal in view of the temperature control, it is preferable to increase the number of the second upper headers 21*b* at the downstream side as much as possible. The residual coolant is likely to be transition boiled or nuclear boiled to cause the temperature unevenness when the strip temperature becomes lower. It is preferable to allow the residual coolant to leak to the higher temperature side. However, the leakage of the residual coolant has to be minimized, and accordingly, it is preferable to reduce the number of rows of the upper nozzles 22 installed in the upper header 21 as least as possible such that the difference between the number of nozzle rows for injecting the coolant from the first upper header and the number of nozzle rows for injecting the coolant from the second upper header is decreased.

In view of the aforementioned description, the order of the injections performed by the actual cooling header will be described referring to FIGS. 13 and 14.

Figure 13:
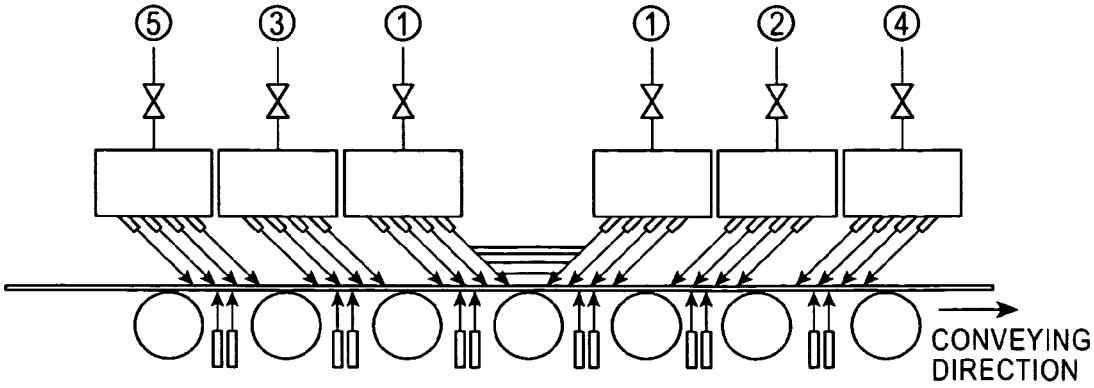
FIG. 13 is an explanatory view of the third aspect of the present invention.

FIG. 13 shows the cooling device according to the present invention for cooling only the upper side of the strip. The number of the headers required for cooling is preliminarily estimated, and the injection is performed from the innermost cooling header. Upon passage of the strip through the cooling device, the temperature at the leading end of the strip is measured. If the temperature of the leading end of the strip is higher than the target temperature, the number of the cooling headers for injecting the coolant is increased. At this time, the coolant is injected sequentially in the order of the circled number as shown in FIG. 13 such that the header at the inner and downstream side is prioritized and the number of the headers at the upstream side becomes equal to that of the headers at the downstream side. Meanwhile, when the temperature of the leading end of the strip becomes lower than the target temperature in the course of the adjustment, the number of the cooling headers for injecting the coolant is reduced. In such a case, the injection of the cooling header is sequentially stopped from the outer side. The injection is stopped from the header with the circled number in descending order.

Figure 14:
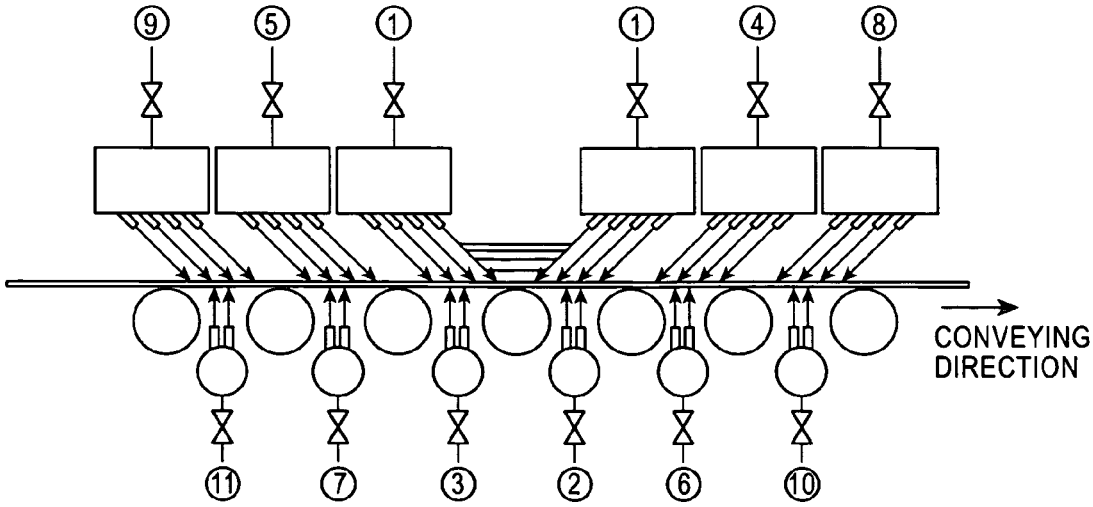
FIG. 14 is an explanatory view of the third aspect of the present invention.
Figure 15:
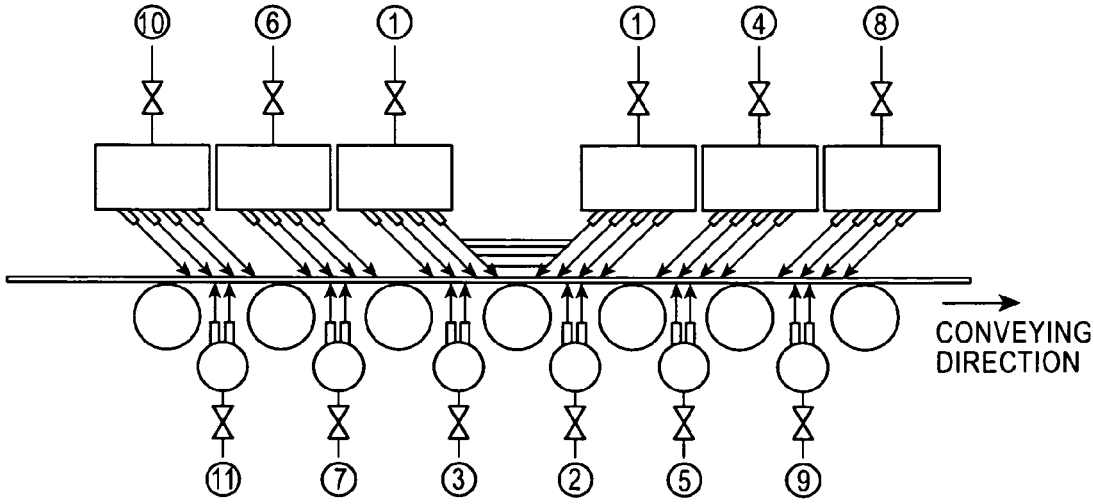
FIG. 15 is an explanatory view of the third aspect of the present invention.
Figure 16:
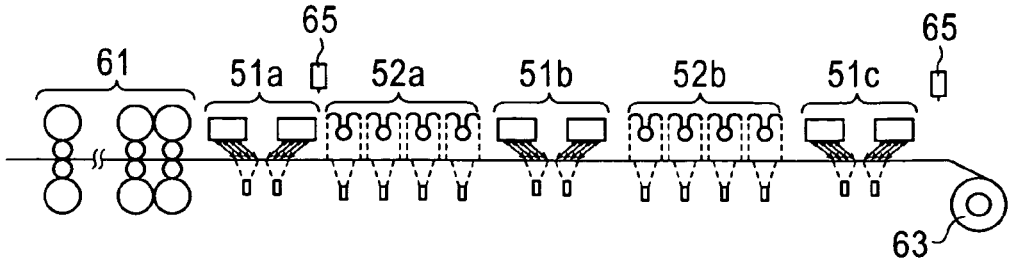
FIG. 16 is an explanatory view of the third aspect of the present invention.

FIG. 14 shows the cooling device for cooling both the upper and the lower sides. When the amount of the coolant for cooling the lower side is large, and the injection pressure becomes high, the aforementioned injection is required. In the aforementioned case, if the coolant is injected only to the lower side, the force for lifting the strip is generated, and as a result, the strip may be lifted up to jump out the line, or impinge against the upper nozzle, resulting in the problem of threading performance.

The coolant is injected to the upper surface to hold the strip on the table roll to switch ON-OFF of the cooling header for injection such that the purging property and the cooling capability are stabilized while keeping the threading of the strip.

In the aforementioned case, the number of the headers required for cooling is preliminarily estimated, and the coolant is injected from the upper headers 21*a* and 21*b* at the innermost sides, and the lower side header. The temperature of the leading end of the strip passing through the cooling device is measured. When the temperature of the leading end of the strip is higher than the target temperature, the number of the cooling headers for injection is increased. The coolant is injected in the order of the circled number as shown in FIG. 14 such that the headers at the inner side and the downstream side are prioritized, and the number of the headers for injection at the upstream side is substantially the same as that of the headers for injection at the downstream side. In this case, preferably the coolant for the lower side is injected in the state where the coolant for the upper side impinges at substantially the same point where the coolant for the lower side impinges, and the coolant impinges against the upper surface. The coolant impinges at the same points on the upper and the lower sides so as to prevent floating of the strip. Referring to the drawing, if the header for injecting the coolant to the upper side is added, the header for injecting the coolant to the lower side is added as well. The aforementioned addition of the headers is repeatedly performed to increase the entire number of the headers for injection. Meanwhile, if the temperature of the leading end of the strip becomes lower than the target temperature in the course of the adjustment, the number of the coolant headers for injection is reduced. In such a case, the injection is stopped from the coolant header at the outer side sequentially. In other words, the injection is stopped from the header in descending order of the circled number as shown in FIG. 14.

The use of the excessively thin strip (for example, the thickness of 1.2 mm) may make the threading performance of the leading end instable in the cooling device according to the present invention. As large amount of coolant is fed to the strip, the coolant serves as the resistance to lower the rate at the leading end of the strip. However, it is pushed from the rolling machine at the constant rate, which may cause the risk of sagging the plate, thus generating the loop. In the aforementioned case, the number of the headers for injecting the coolant only at the leading end of the strip is reduced, the amount of the coolant is reduced or supply of the coolant is stopped such that the cooling is performed with a predetermined amount of coolant or the predetermined numbers of the headers after the passage of the leading end of the strip through the cooling device.

Preferably, ON-OFF (injection-stop) of the coolant from each of the upper headers is quickly switched. Especially when switching OFF of the coolant, the coolant fully filled in the upper header may leak out of the nozzle even if the valve installed in the upstream of the header is closed. Such leaked coolant will be the residual coolant on the strip, thus causing excessive cooling. Preferably, the nozzle is provided with the check valve, or the header is provided with the discharge valve which is opened when stopping the injection of the coolant for immediately discharging the coolant inside the header.

Referring to FIG. 12, the structure for cooling the strip by the cooling device 51 according to the present invention provided at the output side of the finish rolling machine, and further by the existing cooling device 52 has been described. The structure having the cooling device 51*b* between the existing cooling devices 52*a* and 52*a*, or the structure having the cooling device 51*c* according to the present invention disposed downstream of the existing cooling device 52*b* may be employed. The cooling device 51*a* according to the present invention may be disposed at all the positions as described above including the case where the cooling device 51*a* according to the present invention is disposed between the finishing stand and the existing cooling device 52*a*. Alternatively, the structure for cooling only with the cooling device 51 according to the present invention may be employed.

Figure 17:
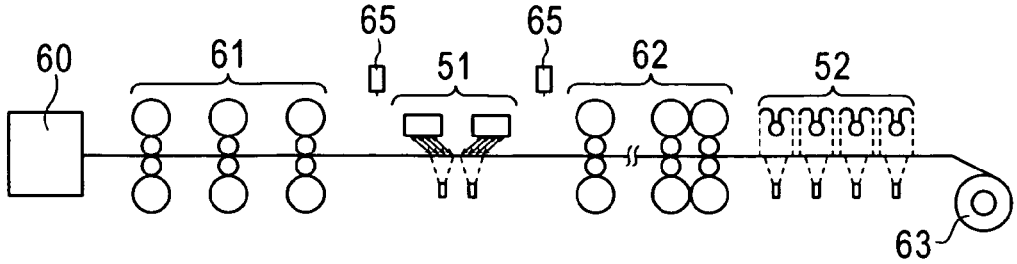
FIG. 17 is an explanatory view of the third aspect of the present invention.

The cooling device 51 according to the present invention may be disposed at an arbitrary position on the line for manufacturing the hot strip, for example, at the position between the roughing stand 61 and the finishing stand 62 as shown in FIG. 17.

EMBODIMENTS

Embodiment 1

Figure 18:
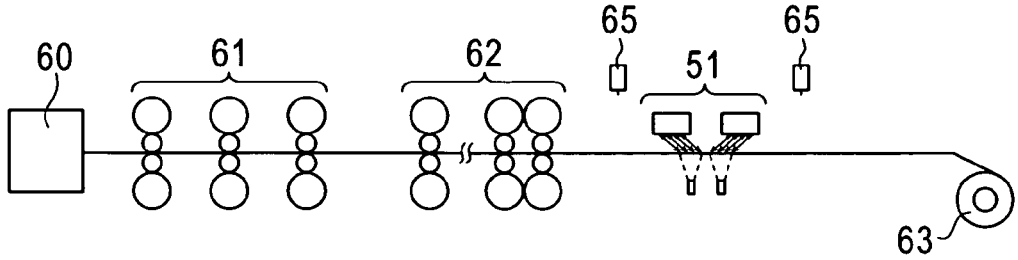
FIG. 18 is an explanatory view of an example according to Embodiment 1.
Figure 19:
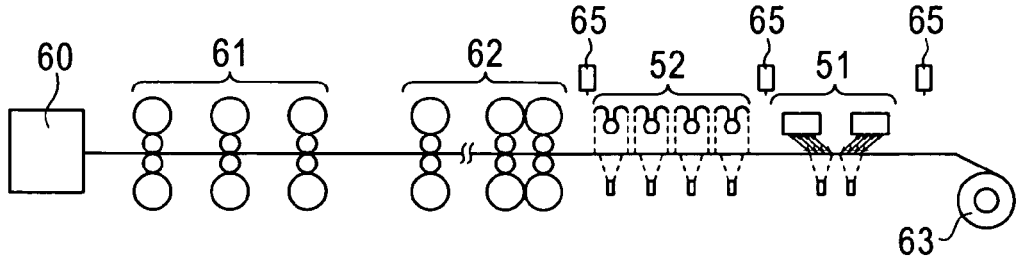
FIG. 19 is an explanatory view of an example according to Embodiment 1.
Figure 20:
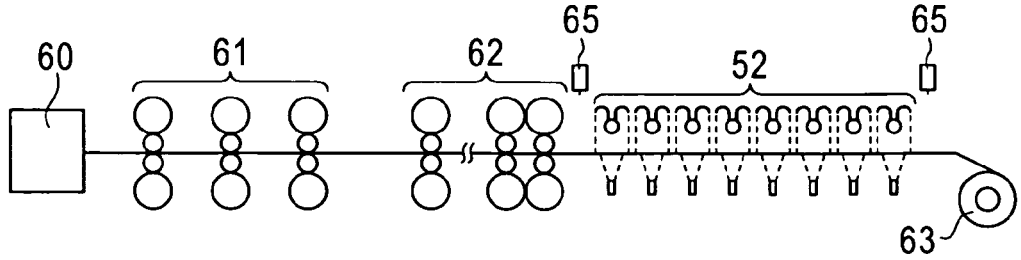
FIG. 20 is an explanatory view of a comparative example of Embodiment 1.

In Embodiment 1, the cooling device 51 according to the present invention is disposed at the output side of the finishing stand 62 as shown in FIGS. 18, 19 and 20 for manufacturing the hot strip. In the manufacturing conditions, the slab with the thickness of 240 mm is heated to 1200° C. in the heating furnace 60, rolled by the roughing stand 61 to the thickness of 35 mm, and further rolled by the finishing stand 62 at the temperature at the end of finishing of 850° C. to the thickness of 3.2 mm. It is then cooled by the cooling device to 450° C. so as to be coiled by the coiler 63.

In Examples 1 to 5, the cooling device 51 according to the present invention (cooling device 20 according to the first aspect, cooling device 40 according to the second aspect) is disposed as shown in FIGS. 18 and 19 to cool the finished strip. In Comparative Examples 1 to 3 as shown in FIG. 20, the finished strip is cooled by the existing cooling device 52 without using the cooling device 51 according to the present invention.

Example 1

In Example 1, the cooling device 51 of the present invention was disposed at the output side of the finishing stand 62 as shown in FIG. 18 for cooling the strip finished at 850° C. to 450° C.

In this case, the cooling device 20 according to the first aspect was used as the cooling device 51 of the present invention, using 10 upper headers 21*a* and 21*b* (20 upper headers in total) each at the depression θ of 45° in the conveying direction, and 20 spray cooling headers corresponding to the upper headers for cooling the lower side. As the nozzles for the upper headers 21, round type nozzles 22 (inner diameter: 8 mm) were inclined outward in the width direction at the installation pitch of 70 mm in the width direction at the same outward angle (α=20°). The round type nozzles 22 in four rows were installed in the upper headers 21 in the strip conveying direction, and the injection rate of the rod-like flow was set to 8 m/s. The upper nozzle 22 was positioned at the height 1200 mm from the table roll. The coolant amount density was 3 $m^3/m^2$ min for both the upper and the lower sides.

The rolling rate was kept constant at 550 mpm, and the strip temperature before entering into the cooling device 51 was adjusted to be constant. The predetermined numbers of the headers for injecting the coolant were operated in the order from the inner side preferentially. The number of the headers for injecting the coolant was not changed while cooling the strip.

Example 2

In Example 2, the cooling device 51 of the present invention was disposed at the output side of the finishing stand 62 as shown in FIG. 18 for cooling the strip finished at 850° C. to 450° C.

Example 2 was substantially the same as Example 1 except that the number of the headers for injecting the coolant was changed for correcting the difference between the temperature measured by the thermometer 65 disposed at the output side of the cooling device 51 while cooling the strip and the target temperature.

Example 3

In Example 3, the existing cooling device 52 and the cooling device 51 of the present invention were disposed at the output side of the finishing stand 62. The strip finished at 850° C. was cooled by the existing cooling device 52 to 600° C., and further cooled by the cooling device 51 to 450° C.

The existing cooling device 52 employed the hair-pin laminar cooling for the upper side, and the spray cooling for the lower side having the coolant amount density set to 0.7 $m^3/m^2$ min.

Meanwhile, the cooling device 20 according to the first aspect was employed as the cooling device 51 of the present invention, having 10 upper headers 21*a* and 21*b* (20 upper headers in total) each at the depression θ of 45° in the conveying direction. The lower side cooling was performed by 20 spray cooling headers corresponding to the upper headers. As the nozzles for the upper headers 21, round type nozzles 22 (inner diameter: 8 mm) were arranged without being inclined outward in the width direction (α=0°) at the installation pitch of 70 mm in the width direction. The round type nozzles 22 in four rows were installed in the upper headers 21 in the strip conveying direction, and the injection rate of the rod-like flow was set to 8 m/s. The upper nozzle 22 was positioned at the height 1200 mm from the table roll. The coolant amount density was 3 $m^3/m^2$ min for both the upper and the lower sides.

The rolling rate was kept constant at 550 mpm, and the strip temperature before entering into the cooling device 51 was adjusted to be constant. The predetermined numbers of the headers for injecting the coolant were operated from the inner side preferentially. The number of the headers for injecting the coolant was changed for correcting the difference between the temperature measured by the thermometer 65 disposed at the output side of the cooling device 51 while cooling the strip and the target temperature.

Example 4

In Example 4, the cooling device 51 of the present invention was disposed at the output side of the finishing stand 62 as shown in FIG. 18 for cooling the strip finished at 850° C. to 450° C.

The cooling device 40 according to the second aspect including the shielding plate 26 was employed as the cooling device 51 of the present invention, having 10 upper headers 21*a* and 21*b* (20 upper headers in total) each at the depression θ of 50° in the conveying direction. The lower side cooling was performed by 20 spray cooling headers corresponding to the upper headers. As the nozzles for the upper headers 21, the round type nozzles 22 (inner diameter: 8 mm) in the center of the width had the outward angle α set to 0 at the installation pitch of 100 mm in the width direction while gradually increasing the outward angle α towards the ends of the width at 10°. The round type nozzles 22 in four rows were installed in the upper headers 21 in the strip conveying direction, and the injection rate of the rod-like flow was set to 8 m/s. The upper nozzle 22 was positioned at the height 1200 mm from the table roll. The coolant amount density was 3 $m^3/m^2$ min for both the upper and the lower sides.

The rolling rate was kept constant at 550 mpm, and the strip temperature before entering into the cooling device 51 was adjusted to be constant. The predetermined numbers of the headers for injecting the coolant were operated in the order from the inner side preferentially. The number of the headers for injecting the coolant was changed for correcting the difference between the temperature measured by the thermometer 65 disposed at the output side of the cooling device 51 while cooling the strip and the target temperature.

Example 5

In Example 5, the existing cooling device 52 and the cooling device 51 of the present invention 51 were disposed at the output side of the finishing stand 62 as shown in FIG. 19. The strip finished at 850° C. was cooled to 600° C. by the existing cooling device 52, and further cooled to 450° C. by the cooling device 51 according to the present invention.

The existing cooling device 52 employed the hair-pin laminar cooling for the upper side and the spray cooling for the lower side with the coolant amount density of 0.7 $m^3/m^2$ min.

The cooling device 40 according to the second aspect including the shielding curtain 28 was employed as the cooling device 51 of the present invention, having 10 upper headers 21*a* and 21*b* (20 upper headers in total) each at the depression θ of 50° in the conveying direction. The lower side cooling was performed by 20 spray cooling headers corresponding to the upper headers. As the nozzles for the upper header 21, the round type nozzles 22 (inner diameter: 8 mm) in the center of the width had the outward angle α set to 0 at the installation pitch of 100 mm in the width direction while gradually increasing the outward angle α toward the ends of the width at 25°. The round type nozzles 22 in four rows were installed in the upper headers 21 in the strip conveying direction, and the injection rate of the rod-like flow was set to 8 m/s. The upper nozzle 22 was positioned at the height 1200 mm from the table roll. The coolant amount density was 3 $m^3/m^2$ min for both the upper and the lower sides.

The rolling rate was kept constant at 550 mpm, and the strip temperature before entering into the cooling device 51 was adjusted to be constant. The predetermined numbers of the headers for injecting the coolant were operated in the order from the inner side preferentially. The number of the headers for injecting the coolant was changed for correcting the difference between the temperature measured by the thermometer 65 disposed at the output side of the cooling device 51 while cooling the strip and the target temperature.

Comparative Example 1

In Comparative Example 1, the existing cooling device 52 was disposed at the output side of the finishing stand 62 for cooling the strip finished at 850° C. to 450° C.

The existing cooling device 52 employed the hair-pin laminar cooling for the upper side, and the spray cooling for the lower side with the coolant amount density of 0.7 $m^3/m^2$ min. The distance from the cooling nozzle to the table roll was set to 1200 mm.

The rolling rate was kept constant at 550 mpm, and the strip temperature before entering into the cooling device 51 was adjusted to be constant. The predetermined numbers of the headers for injecting the coolant were operated. The number of the headers for injecting the coolant was changed for correcting the difference between the temperature measured by the thermometer 65 disposed at the output side of the cooling device 51 while cooling the strip and the target temperature.

Comparative Example 2

In Comparative Example 2, the cooling device disclosed in Patent Document 1 was disposed instead of the existing cooling device 52 as shown in FIG. 20 for cooling the strip finished at 850° C. to 450° C.

The cooling device disclosed in Patent Document 1 was structured to inject the coolant from the slit nozzle units (gap of the slit nozzle: 5 mm) arranged opposite the conveying direction, and to lift the slit nozzle unit so as to set the distance between the nozzle and the table roll to a predetermined value (100 mm). Likewise Examples 1 to 5, the coolant amount density was set to 3 $m^3/m^2$ min.

The rolling rate was kept constant at 550 mpm, and the strip temperature before entering into the cooling device was adjusted to be constant. The predetermined numbers of the headers for injecting the coolant were operated. The number of the headers for injecting the coolant was changed for correcting the difference between the temperature measured by the thermometer 65 disposed at the output side of the cooling device while cooling the strip and the target temperature.

Comparative Example 3

In Comparative Example 3, the cooling device disclosed in Patent Document 2 was disposed instead of the existing cooling device 52 as shown in FIG. 20 for cooling the strip finished at 850° C. to 450° C.

The cooling device disclosed in Patent Document 2 is structured to allow the slit nozzle units (slit nozzle gap: 5 mm) oppositely arranged with respect to the conveying direction to inject the coolant, and has a partition plate above the nozzle. In the comparative example, the distance between the nozzle and the table roll was set to 150 mm, and the distance between the partition plate and the table roll was set to 400 mm. The coolant amount density was set to 3 $m^3/m^2$ min likewise the Examples 1 to 5.

The rolling rate was kept constant at 550 mpm, and the strip temperature before entering into the cooling device was adjusted to be constant. The predetermined numbers of the headers for injecting the coolant were operated. The number of the headers for injecting the coolant was changed for correcting the difference between the temperature measured by the thermometer 65 disposed at the output side of the cooling device 51 while cooling the strip and the target temperature.

It has been preliminarily confirmed that the temperature of the cooled finished strip substantially corresponds to the tensile strength as the material property. As a result, the acceptable temperature difference after cooling was set to 50° C. If the temperature difference is larger than the acceptable value, variation in the material becomes too large to be shipped.

The temperature of the cooled strip in each of Examples 1 to 5, and Comparative Examples 1 to 3 was measured with the radiation thermometer for evaluation based on the resultant temperature difference. The measurement results are shown in Table 2.

TABLE 2

| | Coolant | Aspect | Distance from cooling header to table roll | Drawing | Injection direction θ | Injection direction α | Temperature at the end of cooling | Temperature difference after cooling | Damage | Change in Number of cooling headers |
|---|---|---|---|---|---|---|---|---|---|---|
| Ex. 1 | Rod-like flow | 1st aspect | 1200 mm | FIG. 18 | 45° | 20° | 450° C. | 15° C. | Not damaged | Not changed |
| Ex. 2 | Rod-like flow | 1st aspect | 1200 mm | FIG. 18 | 45° | 20° | 450° C. | 7° C. | Not damaged | Changed |

TABLE 2-continued

| | Coolant | Aspect | Distance from cooling header to table roll | Drawing | Injection direction θ | Injection direction α | Temperature at the end of cooling | Temperature difference after cooling | Damage | Change in Number of cooling headers |
|---|---|---|---|---|---|---|---|---|---|---|
| Ex. 3 | Rod-like flow | 1st aspect | 1200 mm | FIG. 19 | 45° | 0° | 450° C. | 15° C. | Not damaged | Changed |
| Ex. 4 | Rod-like flow | 2nd aspect | 1200 mm | FIG. 18 | 50° | 10° | 450° C. | 5° C. | Not damaged | Changed |
| Ex. 5 | Rod-like flow | 2nd aspect | 1200 mm | FIG. 19 | 50° | 25° | 450° C. | 13° C. | Not damaged | Changed |
| Comp. Ex. 1 | Hair-pin laminar | — | 1200 mm | FIG. 20 | — | — | 450° C. | 120° C. | Not damaged | Changed |
| Comp. Ex. 2 | Film-like coolant | — | 100 mm | FIG. 20 | — | — | 450° C. | 20° C. | Frequently damaged | Changed |
| Comp. Ex. 3 | Film-like coolant | — | 150 mm | FIG. 20 | — | — | 450° C. | 50° C. | Frequently damaged | Changed |

In Comparative Example 1 provided with the existing cooling device 52, the distance between the table roll and the cooling device was set to be as long as 1200 mm. Although the trouble of impingement of the hot strip against the cooling device did not occur, the temperature difference after cooling was as large as 120° C. The large variation of such property as strength was observed, thus failing to ship the resultant product. As the strip was conveyed to the coiler while having the coolant injected from the cooling device resided thereon for a long time, the portion with the residual coolant was only cooled. The error correction was conducted using the thermometer at the output side of the cooling device for solving the aforementioned problem. The local temperature unevenness was observed at a part of the strip. The feedback for changing the number of the headers for injecting the coolant was too late to fail to conduct the adjustment. As a result, the large temperature unevenness was kept unsolved.

In Comparative Example 2 provided with the oppositely arranged slit nozzles for injecting the coolant as disclosed in Patent Document 1, the hot strip jumped up to the height of approximately 200 to 300 mm while being finished and conveyed to the coiler to frequently cause such trouble as impingement against the cooling device. Meanwhile, the temperature difference with respect to the cooled hot strip without being impinged against the cooling nozzle was 40° C. lower than the target acceptable temperature difference after the cooling at 50° C. The unevenness of such material as strength was small. In the case where the good threading performance was obtained, the slit nozzles were oppositely arranged for injection, and no residual coolant existed on the strip. The resultant temperature difference was relatively small, but larger than each temperature difference of Examples 1 to 5 as described later. The subsequent research on the cooling nozzles revealed that foreign substances were observed, and the slit gap varied in the range of approximately ±2 mm, which was considered to be caused by the thermal deformation. As a result, the injected flow rate varied in the width direction of the cooling device, thus slightly increasing the temperature difference.

In Comparative Example 3 provided with the oppositely arranged slit nozzles for injecting the coolant as disclosed in Patent Document 2, the hot strip jumped up to the height of approximately 200 to 300 mm in the course of finishing and conveying to the coiler to frequently cause such trouble as impingement against the cooling device. Meanwhile, the temperature difference with respect to the cooled hot strip without being impinged against the coolant nozzle was within the range of the target acceptable temperature difference after the cooling at 50° C. The variation of such material as strength was small. In the case where the good threading performance was obtained, the slit nozzles were oppositely arranged for injection, and no residual coolant existed on the strip. The resultant temperature difference was relatively small, but larger than each temperature difference of Examples 1 to 5. The subsequent research on the cooling nozzles revealed that the foreign substances were observed, and the slit gap varied in the range of approximately ±3 mm, which was considered to be caused by the thermal deformation. As a result, the injected flow rate varied in the width direction of the cooling device, thus slightly increasing the temperature difference.

In Example 1, the distance between the table roll and the cooling device was set to be as long as 1200 mm. The trouble of impingement of the hot strip against the cooling device did not occur, and the temperature difference after cooling was as small as 15° C. The variation of such property as strength was hardly observed as the rod-like flows were injected from opposite directions for cooling while preventing the coolant from residing on the strip.

In Example 2, the distance between the table roll and the cooling device was set to be as long as 1200 mm likewise Example 1. The trouble of impingement of the hot strip against the cooling device did not occur, and the temperature difference after cooling was as small as 7° C. which was lower compared with Example 1. The variation of such property as strength was hardly observed as the rod-like flows were injected from opposite directions for cooling while preventing the coolant from residing on the strip. Additionally, the number of the headers for injecting the coolant was adjusted appropriately for correcting the error based on the temperature measured by the thermometer.

In Example 3, the distance between the table roll and the cooling device was set to be as long as 1200 mm. The trouble of impingement of the hot strip against the cooling device hardly occurred, and the temperature difference was 20° C. which was substantially the same as that of Example 1. The temperature difference became slightly large owing to the residual coolant on the strip at the former cooling stage using the existing cooling device. However, the strip was immediately cooled using the cooling device of the present invention to shorten the duration for which the coolant resides. Additionally, the number of the headers for injecting the coolant was changed to correct the difference based on the temperature measured by the thermometer. The resultant effects allowed the temperature difference to be substantially the same as that of Example 1.

In Example 4, the distance between the table roll and the cooling device was set to be as long as 1200 mm. The trouble of impingement of the hot strip against the cooling device did not occur, and the temperature difference after cooling was as small as 5° C. The variation of such property as strength was hardly observed because the strip was cooled by opposite injections of the rod-like flows while preventing the residual coolant from residing on the strip. The temperature difference observed to be better than that of Example 1 because the shielding plate appropriately shielded the scattering flow, and the number of the headers was appropriately changed to correct the error based on the temperature measured by the thermometer.

In Example 5, as the distance between the table roll and the cooling device was set to be as long as 1200 mm, the trouble of impingement of the hot strip against the cooling device did not occur. The temperature difference after cooling was as small as 13° C. The unevenness of such property as strength was hardly observed because the strip was cooled by opposite injections of the rod-like flows while preventing the residual coolant from residing on the strip. The temperature difference after cooling was observed better than the value of Example 1 because of the shielding curtain for appropriately shielding the scattering flow and change in the number of the headers for injecting the coolant for correcting the error based on the temperature measured by the thermometer appropriately. The temperature difference was slightly larger than those values of Examples 2 and 4 because of the residual coolant on the strip upon former cooling by the existing cooling device. The strip was immediately cooled by the cooling device of the present invention to substantially shorten the duration for which the coolant resided. As a result, the temperature difference may be made negligible.

The use of the present invention for cooling the finished hot strip allows the coolant to be appropriately purged on the strip without impingement against the upper headers and upper nozzles and without causing the thermal deformation or clogging of the nozzle with the foreign substance. The possibility of uniform cooling was confirmed.

Embodiment 2

Figure 21:
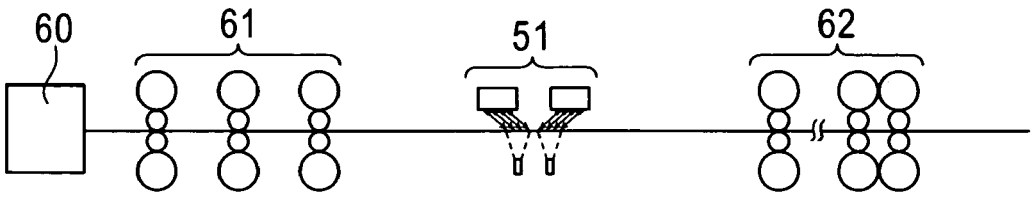
FIG. 21 is an explanatory view of an example according to Embodiment 2.
Figure 22:
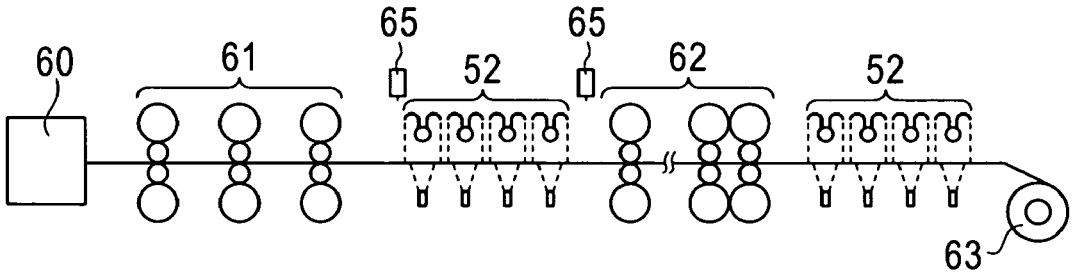
FIG. 22 is an explanatory view of a comparative example of Embodiment 2.

In Embodiment 2, the cooling device 51 of the present invention is disposed between the roughing stand 61 and the finishing stand 62 for manufacturing the hot strip as shown in FIGS. 21 and 22.

In the manufacturing conditions for Embodiment 2, the slab with the thickness of 240 mm is heated to 1200° C. in a heating furnace 60, rolled by the roughing stand 61 to the thickness of 35 mm at the roughed temperature of 1100° C. It is cooled by the cooling device to 1000° C. and further rolled by the finishing stand 62 to the thickness of 3.2 mm. It is then cooled by the cooling device to the predetermined temperature so as to be coiled by the coiler 63.

In Examples 6 and 7, the cooling device 51 of the present invention (cooling device 20 according to the first aspect, cooling device 40 according to the second aspect) is disposed as shown in FIG. 21 to cool the finished strip. In Comparative Example 4, the finished strip was cooled by the existing cooling device 52 without using the cooling device 51 of the present invention.

Example 6

In Example 6, the cooling device 51 of the present invention was disposed between the roughing stand 61 and the finishing stand 62 as shown in FIG. 21 for cooling the strip roughed at 1100° C. to 1000° C.

In this case, the cooling device 20 according to the first aspect was used as the cooling device 51 of the present invention, using 10 upper headers 21*a* and 21*b* (20 upper headers in total) each at the depression θ of 50° in the conveying direction, and 20 spray cooling headers corresponding to the upper headers for cooling the lower side. As the nozzles for the upper headers 21, the round type nozzles 22 (inner diameter: 8 mm) were inclined outward in the width direction at the installation pitch of 60 mm in the width direction at the same outward angle (α=5°). The round type nozzles 22 in four rows were installed in the upper headers 21 in the strip conveying direction, and the injection rate of the rod-like flow was set to 8 m/s. The upper nozzle 22 was positioned at the height 1200 mm from the table roll. The coolant amount density was 3 $m^3/m^2$ min for both the upper and the lower sides.

The rolling rate was kept constant at 250 mpm, and the strip temperature before entering into the cooling device 51 was adjusted to be constant. The predetermined numbers of the headers for injecting the coolant were operated from the inner side preferentially. The number of the headers for injecting the coolant was not changed while cooling the strip.

Example 7

In Example 7, the cooling device 51 of the present invention was disposed between the roughing stand 61 and the finishing stand 62 as shown in FIG. 21 for cooling the strip roughed at 1100° C. to 1000° C.

The cooling device 40 according to the second aspect including the shielding plate 26 was employed as the cooling device 51 of the present invention, having 10 upper headers 21*a* and 21*b* (20 upper headers in total) each at the depression θ of 45° in the conveying direction. The lower side cooling was performed by 20 spray cooling headers corresponding to the upper headers. As the nozzles for the upper headers 21, the round type nozzles 22 (inner diameter: 8 mm) were inclined outward in the width direction at the installation pitch of 60 mm in the width direction at the same outward angle (α=15°). The round type nozzles 22 in four rows were installed in the upper headers 21 in the strip conveying direction, and the injection rate of the rod-like flow was set to 8 m/s. The upper nozzle 22 was positioned at the height 1200 mm from the table roll. The coolant amount density was 3 $m^3/m^2$ min for both the upper and the lower sides.

The rolling rate was kept constant at 250 mpm, and the strip temperature before entering into the cooling device 51 was adjusted to be constant. The predetermined numbers of the headers for injecting the coolant were operated from the inner side preferentially. The number of the headers for injecting the coolant was not changed while cooling the strip.

Comparative Example 4

In Comparative Example 4, the existing cooling device 52 was disposed between the roughing stand 61 and the finishing stand 62 for cooling the strip roughed at 1100° C. to 1000° C.

The existing cooling device 52 employed the hair-pin laminar cooling for the upper side, and the spray cooling for the lower side with the coolant amount density of 0.7 $m^3/m^2$ min. The distance from the cooling nozzle to the table roll was set to 1200 mm. The rolling rate was kept constant at 250 mpm, and the strip temperature before entering into the cooling device 52 was adjusted to be constant. The predetermined numbers of the headers for injecting the coolant were operated. The number of the headers for injecting the coolant was not changed while cooling the strip.

The temperature at the input side of the finishing stand has to be set to 1000° C., and the temperature difference has to be set to be within 20° C. for suppressing the increase in the finished strip temperature and generation of the surface flaw upon cooling subsequent to the roughing.

The temperature of the cooled strip at the input side of the finishing stand in each of Examples 6 and 7, and Comparative Example 4 was measured with the radiation thermometer for evaluation based on the resultant temperature difference. The measurement results are shown in Table 3.

TABLE 3

| | Coolant | Aspect | Distance from cooling header to table roll | Drawing | Injection direction θ | Injection direction α | Temperature at the end of cooling | Temperature difference after cooling | Damage | Change in Number of cooling headers |
|---|---|---|---|---|---|---|---|---|---|---|
| Ex. 6 | Rod-like flow | 1st aspect | 1200 mm | FIG. 21 | 50° | 5° | 1000° C. | 17° C. | Not damaged | Changed |
| Ex. 7 | Rod-like flow | 2nd aspect | 1200 mm | FIG. 21 | 45° | 15° | 1000° C. | 7° C. | Not damaged | Changed |
| Comp. Ex. 4 | Hair-pin laminar | — | 1200 mm | FIG. 22 | — | — | 1000° C. | 50° C. | Not damaged | Changed |

In Comparative Example 4 using the existing cooling device 52, the distance between the table roll and the cooling device was set to be as long as 1200 mm. Although the trouble of impingement of the hot strip against the cooling device did not occur, the temperature difference at the input side of the finishing stand after cooling was as large as 50° C. As a result, the temperature of the finished strip varied because the strip was conveyed to the input side of the finishing stand while holding the coolant injected to the upper surface of the strip thereon for a long time to cool the portion with the residual coolant.

In Example 6, the distance between the table roll and the cooling device was set to be as long as 1200 mm. The trouble of impingement of the hot strip against the cooling device did not occur. The temperature difference at the input side of the finishing stand after cooling was as small as 17° C. because the oppositely injected rod-like flows for cooling prevented the coolant from residing on the strip.

In Example 7, the distance between the table roll and the cooling device was set to be as long as 1200 mm. The trouble of impingement of the hot strip against the cooling device did not occur. The temperature difference at the input side of the finishing stand after cooling was as small as 7° C. because the oppositely injected rod-like flows for cooling prevented the coolant from residing on the strip. The temperature difference was observed to be better than that of Example 6 as the shielding plate appropriately shielded the scattering flow.

The present invention for cooling the roughed hot strip was used such that the coolant was appropriately purged on the strip without impingement against the upper headers and upper nozzles, and without causing the thermal deformation or clogging of the nozzle with the foreign substance. The possibility of uniform cooling was confirmed.

Embodiment 3

In Embodiment 3, the finished hot strip is cooled using the cooling device according to the present invention by coiling the finished hot strip using the coiler while accelerating the rate.

Example 8

Figure 23:
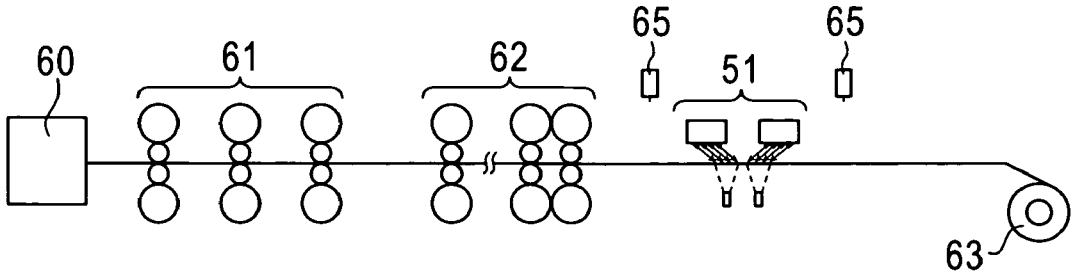
FIG. 23 is an explanatory view of Embodiment 3.

In Example 8, the cooling device 51 of the present invention was disposed at the output side of the finishing stand 62 as shown in FIG. 23 for cooling the hot strip coiled by the coiler 63 while being accelerated.

In the manufacturing conditions, the slab with the thickness of 240 mm was heated to 1200° C. in the heating furnace 60, rolled by the roughing stand 61 to the thickness of 35 mm, and further rolled by the finishing stand 62 at the finishing temperature of 850° C. to the thickness of 3.2 mm. It was then cooled by the cooling device 51 of the present invention to 450° C. so as to be coiled by the coiler 63. The rolling rate (threading rate) upon coiling was 550 mpm. Upon coiling of the leading end of the strip by the coiler 63, the acceleration started at 5 mpm/s, and the rolling rate (threading rate) at the trailing end of the strip was 660 mpm. The entire length of the strip was 600 m.

In this case, the cooling device 20 according to the first aspect was used as the cooling device 51 of the present invention, using 10 upper headers 21*a* and 21*b* (20 upper headers in total) each at the depression θ of 45° in the conveying direction, and 20 spray cooling headers for cooling the lower side. As the nozzles for the upper header 21, the round type nozzles 22 (inner diameter: 8 mm) were inclined outward in the width direction at the installation pitch of 70 mm in the width direction at the same outward angle (α=20°). The round type nozzles 22 in four rows were installed in the upper headers 21 in the strip conveying direction, and the injection rate of the rod-like flow was set to 8 m/s. The upper nozzle 22 was positioned at the height 1200 mm from the table roll. The coolant amount density was 3 $m^3/m^2$ min for both the upper and the lower sides. This allows the upper and the lower sides to have the same cooling capability.

The cooling device 51 according to the present invention was used for cooling the hot strip coiled by the coiler while being accelerated as described above.

Figure 24:
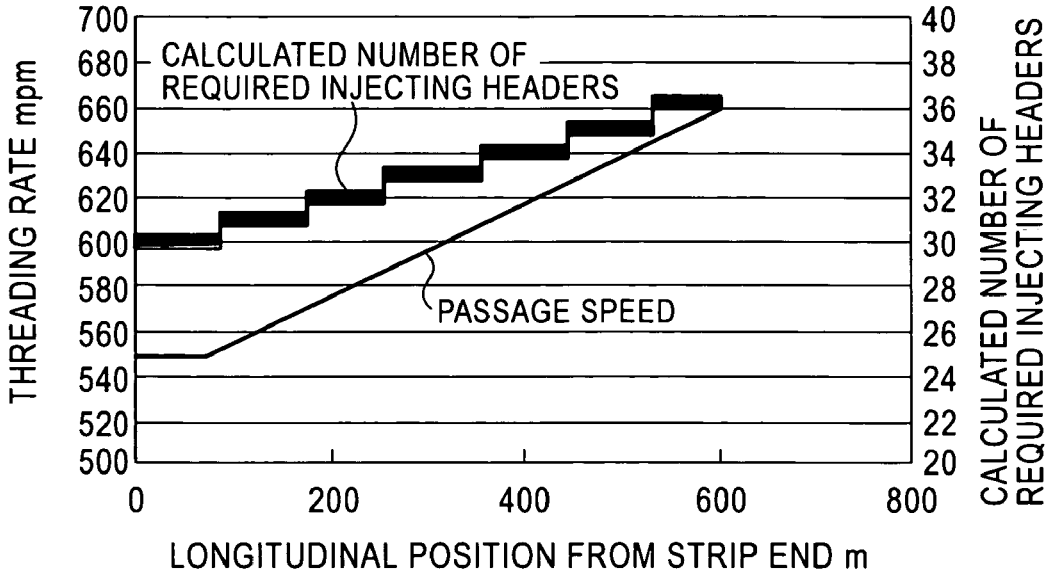
FIG. 24 is an explanatory view of Embodiment 3.

Referring to FIG. 24, the required number of the headers for injecting the coolant of the cooling device in accordance with the respective positions in the longitudinal direction of the strip was calculated based on the cooling rate of the cooling device according to the present invention and the time taken for the strip to pass through the cooling device while considering the acceleration of the hot strip (increase in the threading rate) at each of the positions in the longitudinal direction of the strip as shown in FIG. 24. The required number of the headers for injection shown in FIG. 24 (30 to 36 headers) represents the total number of the upper and the lower headers.

Each position information of the positions of the strip in the longitudinal direction was tracked, and the coolant was injected while adjusting (increasing) the number of the headers for injecting the coolant so as to establish the calculated required number at each passage of the positions of the hot strip through the cooling device.

The number of the headers for injecting the coolant was adjusted (increased or decreased) for correcting the difference between the temperature measured at the output side of the cooling device and the target temperature.

The number of the cooling headers was adjusted by switching ON-OFF of the coolant from the inner header preferentially in the order of the circled number as shown in FIG. 14.

Comparative Example 5

In Comparative Example 5, the number of the headers for injecting the coolant (30 headers) required at the threading rate before acceleration of the strip was kept unchanged without adjusting the number of the headers for injecting the coolant in consideration with the strip acceleration.

Figure 25:
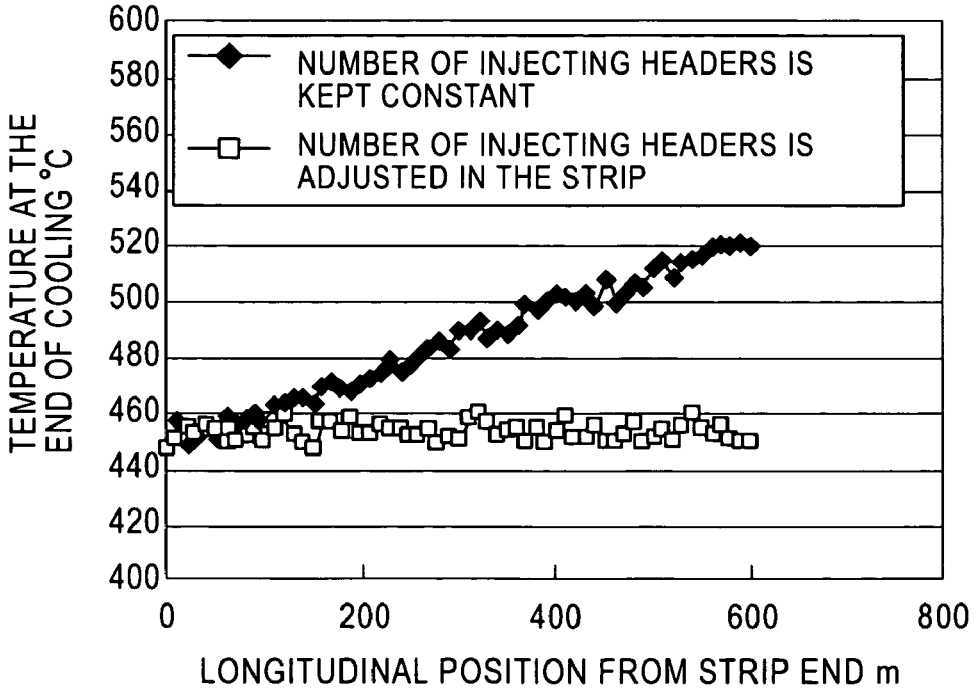
FIG. 25 is an explanatory view of Embodiment 3.
Figure 26:
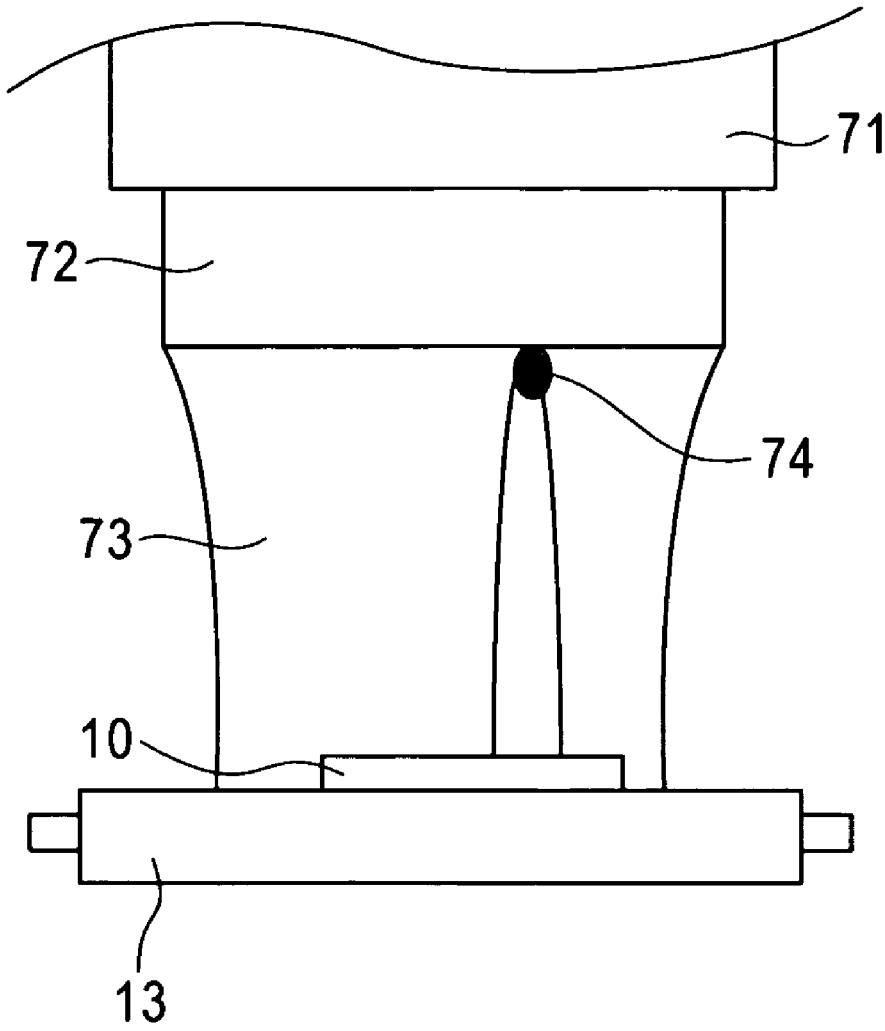
FIG. 26 is an explanatory view of related art.

FIG. 25 shows the comparison between the case for cooling while keeping the number of the headers constant and the case for cooling while adjusting the number of the headers for injecting the coolant as in Example 8.

Upon cooling while keeping the number of the headers for injecting the coolant unchanged as Comparative Example 5, the temperature of the strip at the end of the cooling was likely to be increased as the strip was accelerated. If the number of the headers for injecting the coolant is adjusted in consideration with the strip acceleration as described in Example 8, the uniform temperature at the end of cooling in the longitudinal direction of the strip may be obtained.

INDUSTRIAL APPLICABILITY

Application of the present invention for cooling the finished strip allows the temperature to be accurately controlled to the value equal to or lower than 500° C. which has conventionally failed to achieve the accurate temperature value at the end of cooling. As a result, the material variation of the hot strip at the coiling temperature equal to or lower than 500° C. with large variation in the strength or ductility is reduced to allow the material control in the narrow range. The temperature adjustment during manufacturing of the hot strip, for example, cooling on the transition from the roughing to finishing may be conducted with higher accuracy, thus reducing the yielding and providing the stabilized quality.

The invention claimed is:

1. A cooling method for a hot strip comprising using a first cooling header group including nozzles for injecting rod-like flows of a coolant diagonally toward a downstream side of an upper surface of the strip to impinge against said surface, and a second cooling header group including nozzles for injecting the rod-like flows of the coolant diagonally toward an upstream side of the upper surface of the strip to impinge against said surface, the first cooling header group and the second cooling header group being oppositely arranged with respect to a strip conveying direction:

the injection rate of the rod-like flow of coolant which impinges against the strip is 8 m/sec or higher and supplying the coolant to the strip with a water amount density of 2.0 $m^3/m^2$ min or higher from the nozzles;

the second cooling header group being positioned sufficiently away from the first cooling header group in the strip conveying direction to define a residual region on the strip having a distance L in the downstream direction between the position at which the most downstream rod-like flows of coolant from the first cooling header group contact the strip and the positions at which the most upstream rod-like flows of coolant from the second cooling header group contact the strip, and said distance L is not more than 1.5 m, the rod-like coolant of at least some of the rod-like flows is injected at an angle so that 10% to 35% of a velocity component of the rod-like flow in the injection direction becomes the velocity component directed outward of the hot strip in a width direction, and adjusting a length of a cooling zone by independently switching ON-OFF each of the cooling headers of the first cooling header group and the second cooling header group.

2. The cooling method for a hot strip according to claim 1, wherein an injection direction of the rod-like flow is set at an angle in a range from 30° to 60° with respect to a forward direction or an inverse direction of the hot strip from a horizontal direction.

3. The cooling method for a hot strip according to claim 1, wherein the rod-like flow is injected so that the number of the rod-like flows each having the velocity component directed outward of the hot strip in the width direction at one side becomes the same as the number of the rod-like flows each having the velocity component directed outward of the hot strip in the width direction at the other side.

4. The cooling method for a hot strip according to claim 1, wherein the rod-like flow is injected so that the velocity component of the rod-like flow directed outward of the hot strip in the width direction is gradually increased as a portion of the hot strip is positioned outward from a center of the hot strip in the width direction.

5. The cooling method for a hot strip according to claim 1, wherein the rod-like flow is injected so that the velocity component of the rod-like flow directed outward of the hot strip in the width direction is kept constant and points where the rod-like flow impinges against the strip are arranged at equal intervals in the width direction of the strip.

6. The cooling method for a hot strip according to claim 1, wherein a temperature of the strip is measured at a downstream side in a strip conveying direction, and switching injection from the respective cooling headers ON-OFF based on the measured temperature of the strip to adjust the temperature of the strip to a target temperature.

7. The cooling method for a hot strip according to claim 1, wherein the cooling headers at inner sides of oppositely disposed first and the second cooling header groups are preferentially operated for injecting the coolant.

* * * * *